United States Patent [19]

Ueda

[11] Patent Number: 5,039,599

[45] Date of Patent: Aug. 13, 1991

[54] METHOD FOR PROCESSING SILVER HALIDE COLOR PHOTOGRAPHIC MATERIALS WHERE THE BLEACH-FIXING BATH HAS A SPECIFIC OPEN AREA VALUE

[75] Inventor: Shinji Ueda, Kanagawa, Japan.

[73] Assignee: Fuji Photo Film Co., Ltd, Kanagawa, Japan

[21] Appl. No.: 413,666

[22] Filed: Sep. 28, 1989

[30] Foreign Application Priority Data

Sep. 28, 1988 [JP] Japan ..... 63-243356

[51] Int. Cl.[5] ..... G03C 5/38; G03C 5/44

[52] U.S. Cl. ..... 430/393; 430/372; 430/428; 430/430; 430/461; 430/463; 430/963

[58] Field of Search ..... 430/393, 430, 461, 963, 430/428, 372, 463

[56] References Cited

U.S. PATENT DOCUMENTS

| | | | |
|---|---|---|---|
| 4,770,987 | 9/1988 | Takahashi et al. | 430/551 |
| 4,861,702 | 8/1989 | Suzuki et al. | 430/963 |
| 4,931,378 | 6/1990 | Hirano et al. | 430/464 |
| 4,965,175 | 10/1990 | Fujimoto et al. | 430/375 |

FOREIGN PATENT DOCUMENTS

| | | | |
|---|---|---|---|
| 0294769 | 12/1988 | European Pat. Off. . | |
| 135464 | 8/1984 | Japan | 430/399 |
| 1308938 | 3/1973 | United Kingdom . | |
| 1379615 | 1/1975 | United Kingdom . | |

*Primary Examiner*—Charles L. Bowers, Jr.
*Assistant Examiner*—Patrick A. Doody
*Attorney, Agent, or Firm*—Sughrue, Mion, Zinn Macpeak & Seas

[57] ABSTRACT

A method for processing a silver halide color photographic material is disclosed, comprising imagewise exposing the material and continuously processing the material in an automatic processor wherein the bleach-fixing bath contains (i) at least one organic acid ferric complex salt, and (ii) at least one sulfinic acid, and the open area value (X) of said bleach-fixing bath and the water washing bath during the processing is not more than 0.05 $cm^{-1}$.

8 Claims, 7 Drawing Sheets

METHOD FOR PROCESSING SILVER HALIDE COLOR PHOTOGRAPHIC MATERIALS WHERE THE BLEACH-FIXING BATH HAS A SPECIFIC OPEN AREA VALUE

FIELD OF THE INVENTION

The present invention concerns a method for processing silver halide color photographic materials in which there is little oxidation and deterioration of the bleach-fixing components in the bleach-fixing, water washing or water washing-replacing stabilizing processes, and with which there is little process staining.

BACKGROUND OF THE INVENTION

In recent years, demands have arisen for the provision of good photographic performance with the continuous processing of silver halide color photographic materials so as to provide photographic images which are stable with good photographic performance.

Conventionally, after imagewise exposure, silver halide color photographic materials have been processed, for example, by color development, bleaching, washing, fixing, stabilizing and drying, or by color development, bleach-fixing, water washing, stabilizing and drying.

Organic acid ferric complex salts are normally used as bleaching agents and thiosulfates are normally used as fixing agents in bleach-fixing processes. Sulfites are also used as preservatives for the thiosulfates.

In addition to reducing the level of aerial oxidation, sulfites also react with the organic acid ferric complex salts which are used as bleaching agents and they can decrease the oxidizing potential of the bleach-fixing bath (solution). If the amount of sulfite is reduced by aerial oxidation, degradation of the thiosulfate tends to occur in the bleach-fixing bath or in the following water washing bath or stabilizing bath which is used instead of water washing, and the stability of the bath is reduced. In order to overcome this problem, many methods, starting with those in which a movable lid which is opened when photographic material is being transported and closed when photographic material is not being transported, have been devised for reducing the area of contact (the open area) of the processing baths (solutions) with air in automatic processors (i.e., automatic developing machines) as described in JP-A-64-82033 (the term "JP-A" as used herein refers to a "published unexamined Japanese patent application").

Moreover, even if the open area of the bleach-fixing bath is simply reduced then in cases where a large quantity of photographic material is being processed in a continuous process, for example, ferrous ion is produced in the bleach-fixing bath by reaction between the sulfite and the organic acid ferric complex salt and by reaction between the metallic silver which has been formed by development and the organic acid ferric complex salt, the oxidizing capacity of the bleach-fixing bath is reduced. Thus, problems inevitably arise with color restoration failure or desilvering failure. However, the oxidizing capacity is not reduced in those cases where there is a large contact area between the bleach-fixing bath and the air since ferrous ion is more easily oxidized by the air than the sulfite.

Hence, it is necessary to resolve the conflict between preventing the occurrence of aerial oxidation of the sulfite and preventing the reduction in the oxidizing capacity of the bleach-fixing bath when determining the open area of the bleach-fixing bath and/or the water washing bath or the stabilizing bath which is used in place of a water washing, and an effective means for achieving this has been obtained.

SUMMARY OF THE INVENTION

Hence, a first object of the present invention is to provide a method for processing silver halide color photographic materials using an automatic processor in which the bleach-fixing bath and the succeeding water washing bath or stabilizing bath which is used in place of a water washing are stable.

A second object of the present invention is to provide a method for processing the materials in which color restoration failure and desilvering failure do not occur.

Thus, the method for processing of the present invention has been discovered as a result of investigating the preservatives used in bleach-fixing baths and the structure of automatic processors.

That is to say, it has been discovered that the aforementioned objects are achieved by means of a method for processing a silver halide color photographic material in which the material is processed continuously in an automatic processor after imagewise exposure, wherein the bleach-fixing bath contains (i) at least one type of organic acid ferric complex salt, and (ii) at least one type of sulfinic acid, and the open area value (X) of at least one of the bleach-fixing bath and the water washing bath during the processing is not more than 0.05 $cm^{31}$ $^{1}$.

Figure 1:
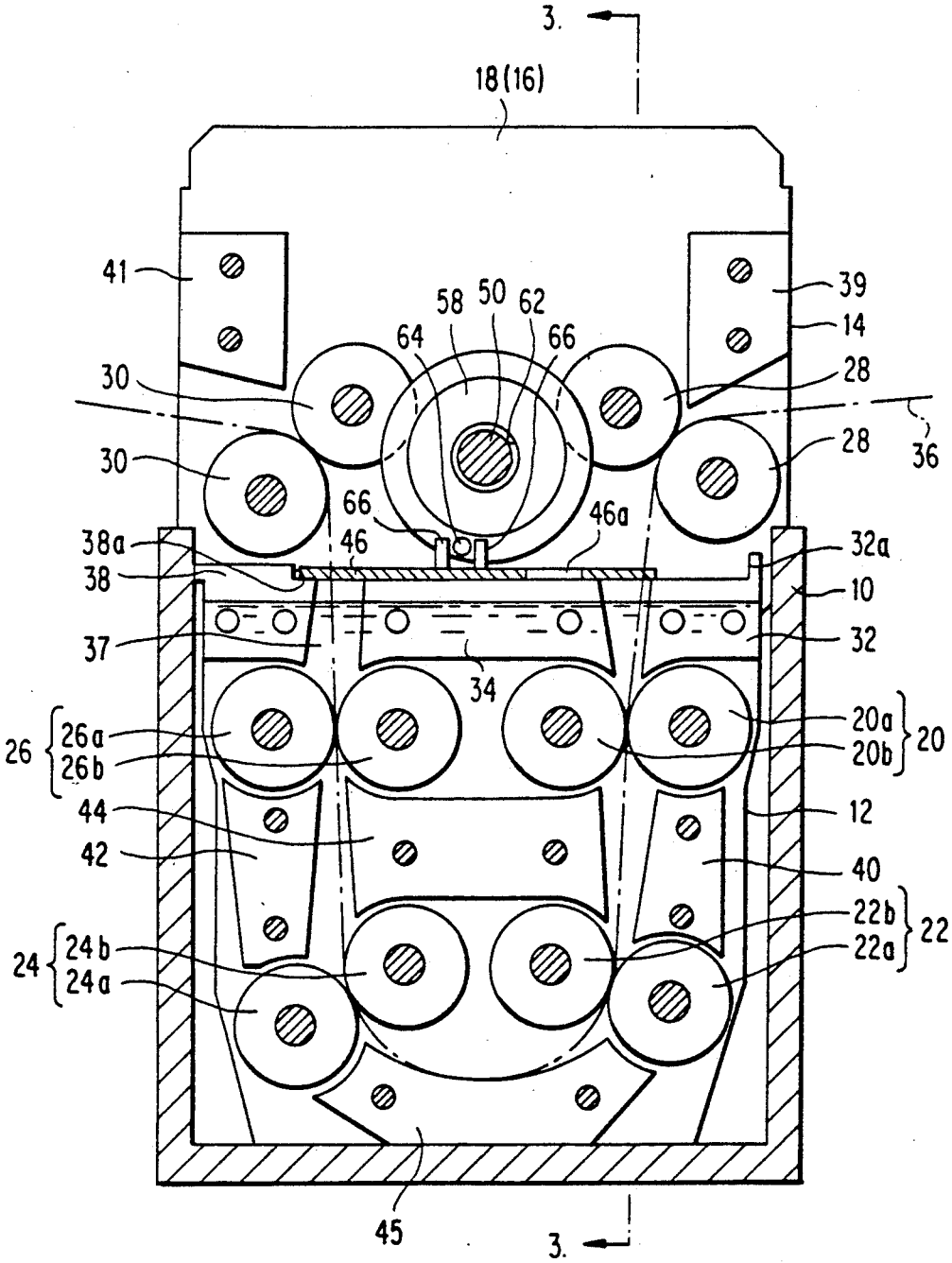
FIG. 1 is a cross sectional view of photographic material processing apparatus which can be used in the present invention.

10 is a processing tank,
12 is a processing bath,
35 is a transporting entry port,
37 is a transporting exit port,
46 is a movable lid,
51 and 52 are each sprockets,
53 is a chain belt,
55 is a motor,
94 and 102 are toothed wheels (i.e., gear).

The water washing bath of the present invention also includes a so-called stabilizing bath which is used in place of a water washing bath.

The term "open area" as used in the present invention is defined in the following way:

[Contact Area between Processing Liquid in Processing Bath Tank and Air ($cm^2$)]/[Volume of Processing Bath Tank ($cm^3$)]=Open Area Value (X) ($cm^{-1}$)

Also, the "open area" is called to the "open degree".

An open area value of not more than 0.05 $cm^{31\ 1}$ (preferably from 0.001 to 0.05 $cm^{-1}$ and more preferably from 0.001 to 0.01 $cm^{-1}$) can be achieved in the present invention using the methods indicated below.

(1) By establishing a movable lid on the top surface of the photographic processing tanks and transporting photographic material by moving this lid.

(2) By fixing the transporting rack to the liquid lid of the photographic processing tank in such a way that the lid can be positioned over the liquid except in the parts through which the photographic material is passed.

(3) By filling the open part of the photographic processing bath (the part where the processing bath is in contact with the air) with a buoyant material which floats on the processing bath.

(4) By floating an organic solvent which has a higher boiling point than water, which has lighter specific gravity than water, and which is immiscible with water as a liquid lid on the open part of the photographic processing tank.

Moreover, the organic solvent can be made to satisfy the above-mentioned requirements by the inclusion of specified compounds in the solvent. Examples of such compounds include n-dodecanol, n-undecanone and liquid paraffin.

The photographic material processing apparatus and the drive for the movable lid of apparatus for the execution of the present invention are described in detail below.

The present invention involves using photographic material processing apparatus in which the photographic material is transported and processed in processing tanks in which the processing baths are supplied. Thus, the present invention can be executed in a photographic material processing apparatus having the transporting ports, established in the aforementioned tanks through which the aforementioned photographic materials are passed and transported into the aforementioned processing tanks and to the outside from within the aforementioned processing tanks, movable lids which assure a closed state when no photographic material is being transported and an open state when such material is being transported, and a drive device which transports the aforementioned photographic material and which drives the aforementioned movable lids and sets the aforementioned transporting ports in the open state.

When, in this apparatus, photographic material is being transported into a processing tank by means of the drive device, the photographic material is transported and the movable lid is driven by the drive power of the drive device and the transporting port is set in the open state. In this state, the photographic material is transported through the transporting port into the processing tank, immersed in the processing bath and processed. The photographic material which has been immersed in the processing bath is then transported to the outside again through a transporting port.

The movable lid is set to the closed state and the surface of the processing bath in the processing tank is covered when no photographic material is being transported. Evaporation of the processing bath can be prevented in this way.

In this embodiment, the movable lid can be driven by reversing the drive device which sets the transporting port in the open state, for example, in order to drive the reversible lid and set the transporting port into the closed state.

Furthermore, the movable lid can be driven by a spring, for example, which acts on the lid and sets it in the closed state, and the transporting port can be set in the open state.

The following nonlimiting embodiments illustrate in greater detail the present invention.

EMBODIMENT 1

A processing tank (color developing tank) 10 of photographic processing apparatus (an automatic processor) to which the present invention has been applied is shown in FIG. 1.

The processing tank 10 is filled with the processing bath 12 and about half of the rack 14 is immersed in the processing bath 12.

Figure 2:
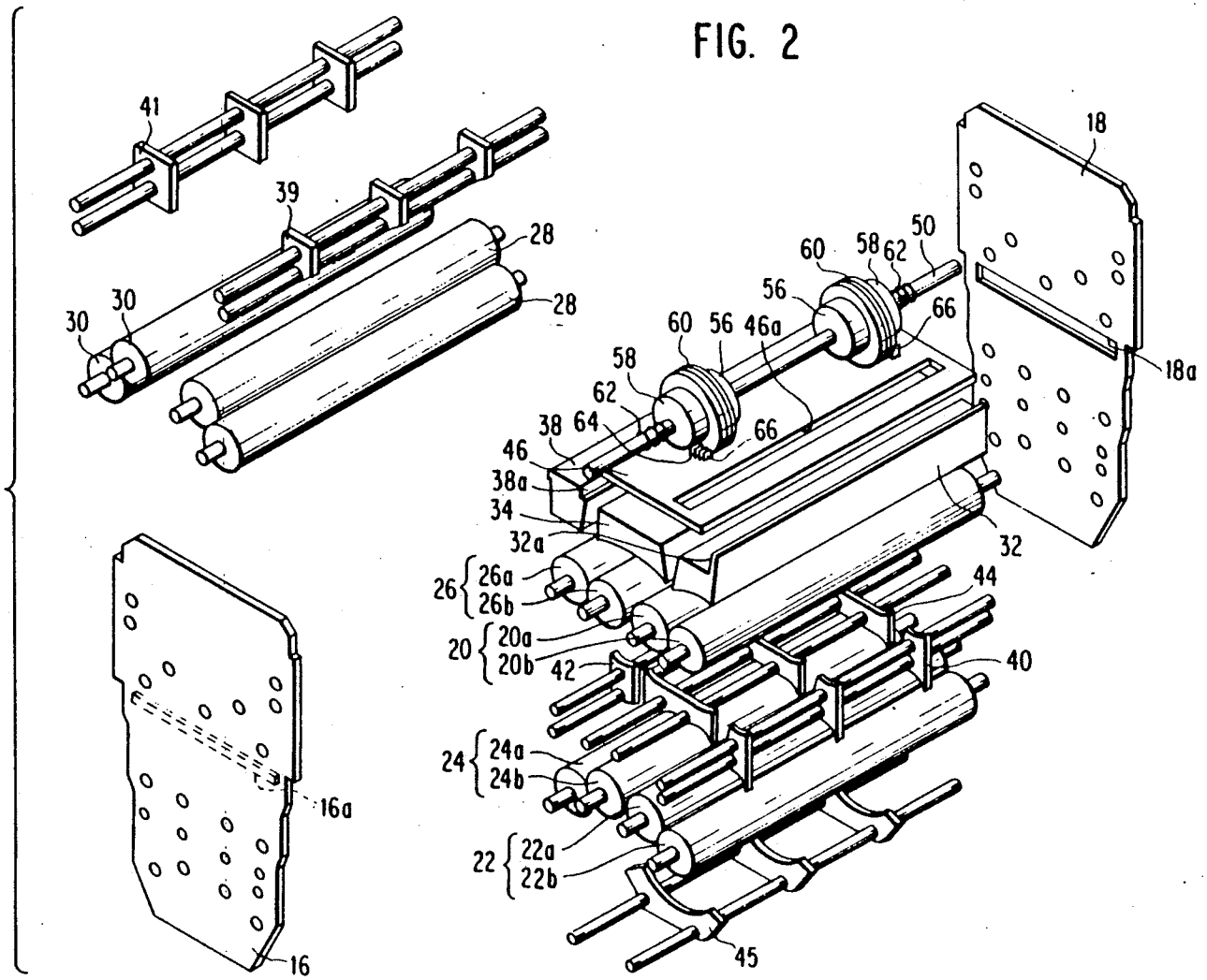
FIG. 2 is an exploded oblique drawing of the rack which is immersed in the processing tank.

The rack 14 is furnished with a pair of side plates 16 and 18, as shown in FIG. 2. These side plates 16 and 18 are supported parallel to one another by means of stays, which are not shown in the drawings but which are arranged between the corners of the side plates 16 and 18. The four sets of transporting rollers 20, 22, 24 and 26 which are immersed in the processing bath 12 are suspended between the side plates 16 and 18.

Furthermore, the two sets of transporting rollers 28 and 30 are suspended between the side plates 16 and 18 above the transporting rollers 20, 22, 24 and 26. The guides 39 and 41 are arranged above the transporting rollers 28 and 30.

Furthermore, the block 32 is suspended between the side plates 16 and 18 over the top of the roller **20*a* of the transporting rollers 20. Furthermore, the block 34 which is wider than the block 32 is arranged over the other roller 20*b* and over the roller 26*b*, this being suspended between the side plates 16 and 18. The transporting entry port 35 for the photographic material 36 is formed between the blocks 32 and 34. Furthermore, the block 38 is also arranged above the roller 26*a* and the transporting exit port 37 for the photographic material 36 is formed between the block 38 and the block 34. A fixed lid is formed by the blocks 23, 24 and 38**.

The guides 40 and 42 are arranged between the roller **20*a* and the roller 22*a*, and between the roller 26*a* and the roller 24*a*, respectively, and a transporting pathway for the photographic material 36 is formed between the guides 40 and 42, and the guide 44 which is arranged in the part surrounded by the rollers 20*b*, 22*b*, 24*b* and 26*b*. The guide 45 which reverses the direction in which the photographic material is being transported is arranged in the part surrounded by the rollers 22*a*, 22*b*, 24*a*, 24*b* and the base of the processing tank 10**.

Hence, the photographic material 36 is guided between the pair of transporting rollers 28 and transported from the transporting entry port 35 into the processing tank 10, after which it passes between the block 32 and the block 34, is transported between the transporting rollers 20 and descends, and is then reversed by the guide 45. The reversed photographic material 36 is guided between the guide 42 and the guide 44 and ascends and is then fed out to the next process by the transporting rollers 30. The movable lid 46 is arranged over the block 34. This movable lid 46 consists of a flat rectangular plate, as shown in FIG. 2, and the two ends in the length direction of the plate are inserted into the slide grooves 16*a* and 18*a* which are established in the side plates 16 and 18 (see FIG. 3) and it can be moved along the width direction of the side plates 16 and 18. A rectangular penetrating hole 46*a* is established in the middle part in the width direction of the movable lid 46.

Figure 3:
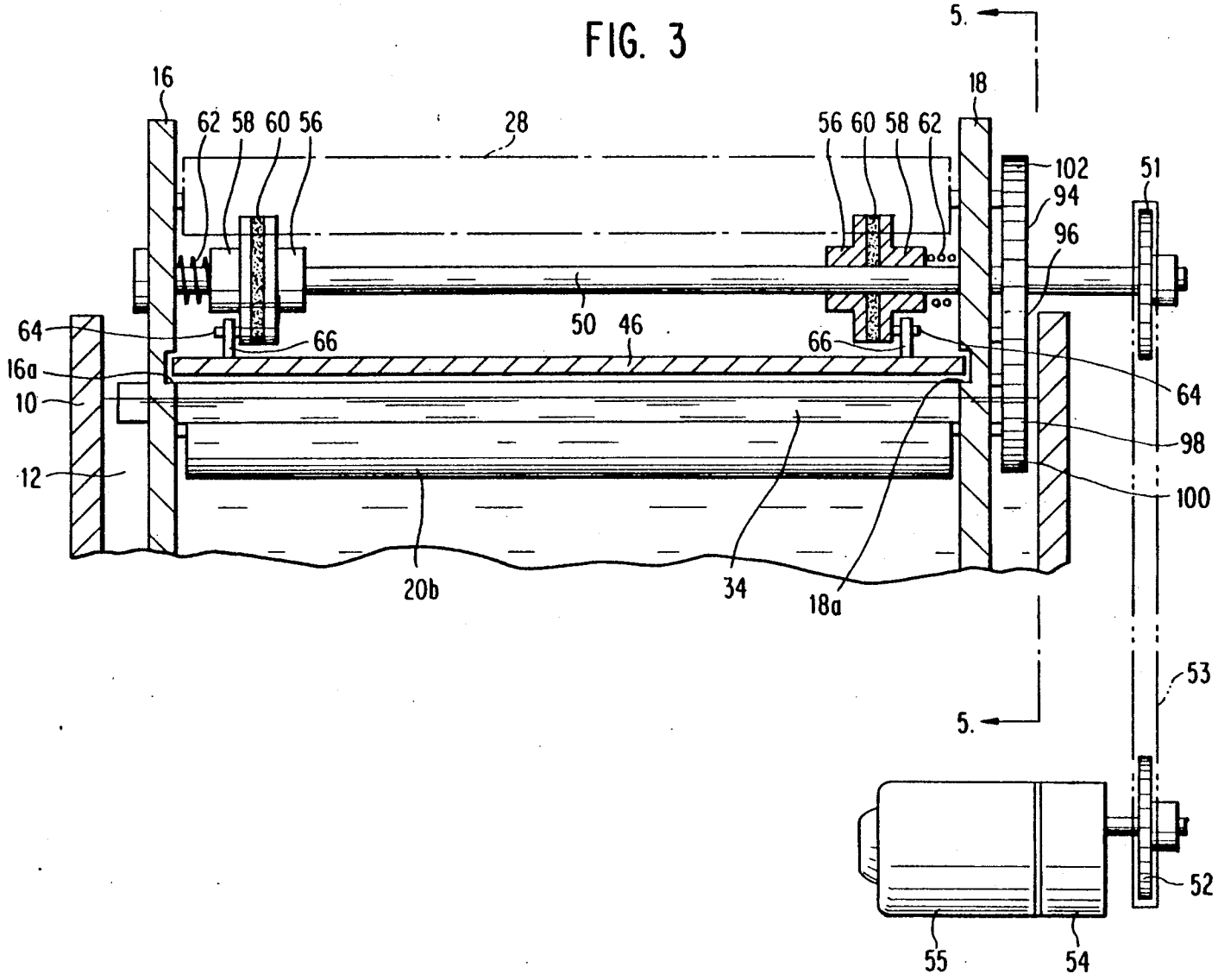
FIG. 3 is a cross sectional view along the line III—III in FIG. 1.

The shaft 50 is suspended between the side plates 16 and 18 above the movable lid 46, and this shaft is supported in such a way that it is able to rotate. One end of the shaft 50 passes through the side plate 18, as shown in FIG. 3 and the end protrudes outward from the processing tank 10. The sprocket 51 is fitted to this end of the shaft 50. The chain belt 53 is fitted around the sprocket 51 and the sprocket 52. The sprocket 52 is fitted to the drive shaft of the motor 55 via the gear box 54. The driving force of the motor 55 is transmitted via the chain belt 53 to the shaft 50 in this way.

Figure 5:
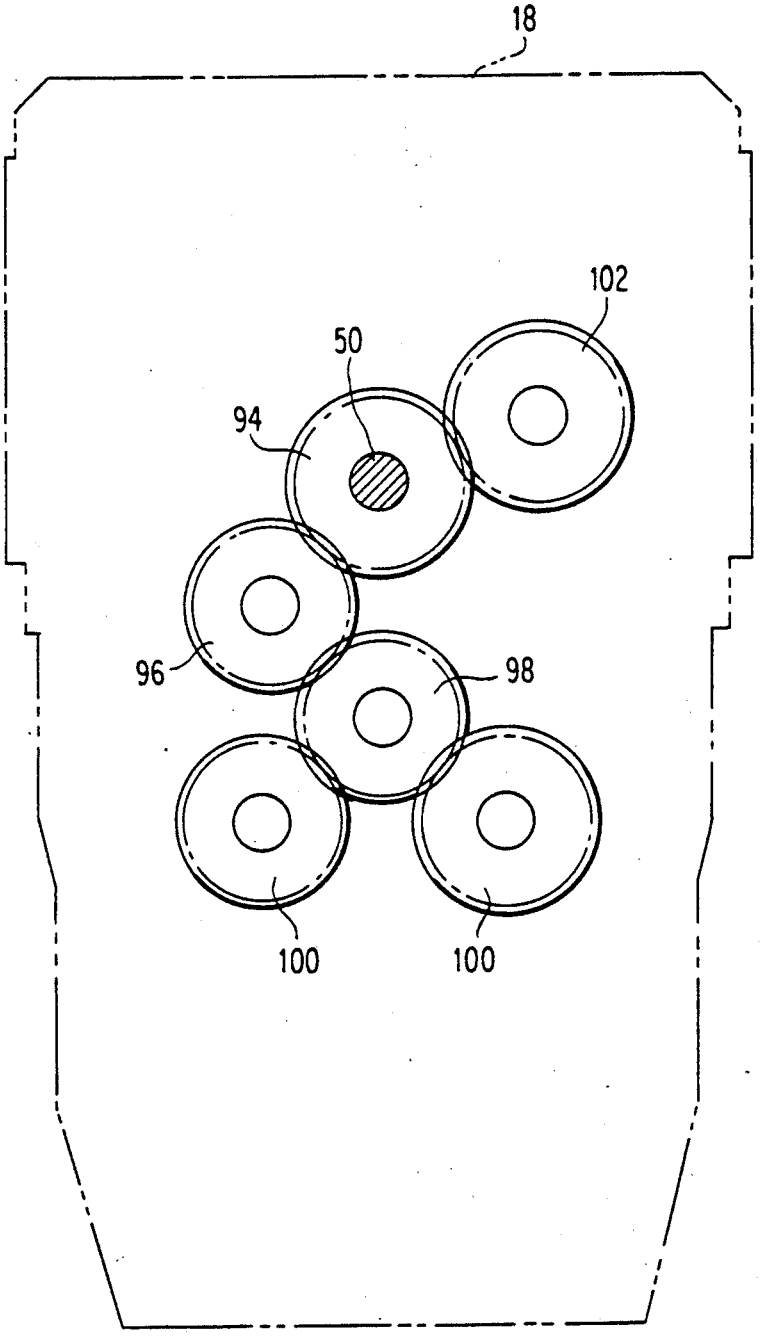
FIG. 5 is a cut-away cross sectional drawing along the line V—V in FIG. 3.

Furthermore, as shown in FIG. 5, the toothed wheel 94 is fitted to the shaft 50 between the side wall of the processing tank 10 and the side plate 18. The toothed wheel 94 is engaged with the toothed wheel 96 which is supported on the side plate 18 and the toothed wheel 96 is engaged with the toothed wheel 98 which is similarly supported on the side plate 18. The toothed wheel 98 is engaged with the toothed wheels 100 which are fitted to the ends of the rotating shafts of the transporting rollers 20*b* and 26*b*, respectively.

Hence, the driving force which is transmitted to the shaft 50 is in turn transmitted to the transporting rollers 20*b* and 26*b* via the toothed wheels 94, 96 and 98 and the toothed wheels 100.

Furthermore, the toothed wheel 102 which is fitted to the end of the rotating shaft of the transporting roller 28 is engaged with the toothed wheel 94, the transporting roller 28 is rotated by the transmitted driving force, and the photographic material 36 is transported in this way.

A pair of fixed flanges 56 are fitted to the shaft 50, as shown in FIG. 3. These fixed flanges 56 are fitted on the shaft 50 between the side plates 16 and 18 and they are arranged in such a way that the wide diameter parts face the side plates 16 and 18, respectively. The movable flanges 58 are arranged facing the wide diameter parts of the fixed flanges 56. The friction materials 60 are arranged between the wide diameter parts of the movable flanges 58 and the fixed flanges 56 and they are fixed to the fixed flanges 56.

Furthermore, the compression coil springs 62 are arranged between the movable flanges 58 and the side plates 16 and 18. The compression coil springs 62 press the movable flanges 58 against the fixed flanges 56 with friction materials 60 in between.

Figure 4:
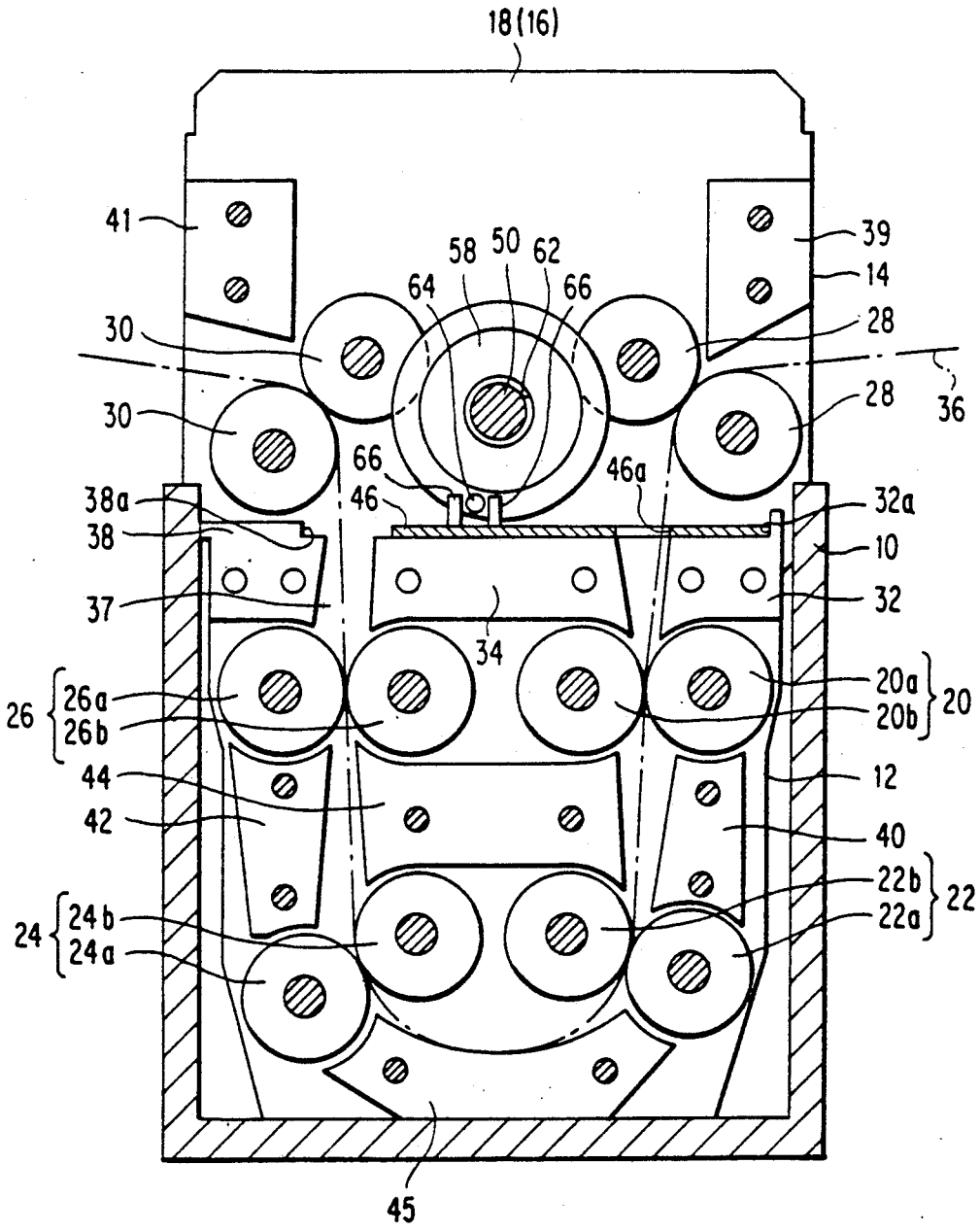
FIG. 4 is a cross sectional drawing which shows the closed state of the movable lid.

The pins 64 are established on the wide diameter parts of the movable flanges 58 with their tips facing the side plates 16 and 18. The pins 64 are arranged between the shaft 50 and the movable lid 46 and fitted between the pairs of protrusions 66 which are established standing up on the movable lid 46. In this way, the rotation when the movable flange 58 is rotated in the counterclockwise direction in FIG. 1, is transmitted via the pins 64 to the movable lid 46 which is slid to the right hand side in FIG. 1 until it makes contact with the stopper 32*a* which is established on the block 32. In this state, the transporting entry port 35 and the transporting exit port 37 for the photographic material 36 are in the open state, as shown in FIG. 4.

Furthermore, when the movable flange 58 is rotated in the clockwise direction in FIG. 1 in this state, the rotation is transmitted via the pins 64 to the movable lid 46 which is moved to the left in FIG. 1 until it makes contact with the stopper 38*a* which is established on the block 38. In this state, the transporting entry port 35 and the transporting exit port 37 for the photographic material 36 are closed, as shown in FIG. 1.

The operation of this illustrative embodiment is described below.

Thus, when photographic material 36 is not being transported in the processing tank 10, the movable lid 46 is in contact with the stopper 38*a* of the block 38, as shown in FIG. 1. In this state, the transporting entry port 35 and the transporting exit port 37 for the photographic material 36 are closed by the movable lid 46. Hence, the processing bath is covered with the fixed lid (the blocks 32, 34 and 38) and the movable lid 46 and evaporation of the processing bath is prevented.

When a photographic material 36 is transported into the processing tank 10 it is gripped between and transported by the transporting rollers 28 and fed into the processing tank 10. At this time, the driving force of the motor 55 which rotates the shaft 50 in the counterclockwise direction in FIG. 1 is transmitted to the transporting roller 28 and the photographic material 36 is transported by the transporting roller 28. At this time, the movable lid 46 is moved to the right hand side in FIG. 1 by the driving force. In this state, the movable lid 46 which blocked the transporting exit port 37 is moved, the penetrating hole 46*a* being made to correspond with the transporting entry port 35, and the open state shown in FIG. 4 is attained.

When the movable lid 46 makes contact with the stopper part 32*a* of the block 32, the movable flanges 58 slide on the friction materials 60 and the driving force which turns the shaft 50 is no longer transmitted to the movable flanges. The driving force which turns the shaft 50 is transmitted the transporting rollers 20*b* and 26*b* and these rollers are driven. As a result of this drive the photographic material 36 passes through the penetrating hole 46*a* and the transporting entry port 35, is gripped between and transported by the transporting rollers 20 and descends into the processing tank 10. The photographic material 36 which has descended within the processing tank 10 is taken up by the transporting roller 22 and then reversed by the guide 45, after which it is gripped by the transporting roller 24 and ascends inside the processing tank 10. The photographic material 36 which is ascending inside the processing tank 10 is gripped by the transporting roller 26 and transported out of the processing bath 12 through the transporting exit port 37 and then it is guided by the pair of transporting rollers 28 and supplied to the next process. The photographic material 36 is immersed in the processing bath 12 in the processing tank 10 and processed in this way.

After the photographic material 36 has been fed out from the processing tank 10, the drive which is transmitted to the transporting rollers 22, 24, 26 and 28 is temporarily stopped. The motor 55 is then reversed and, as a result of this reversal, the movable lid 46 is moved to the left hand side in FIG. 1 and the state shown in FIG. 1 is attained. In this state, the transporting entry port 35 and the transporting exit port 37 are closed by the movable lid 46. The surface of the processing liquid is covered to prevent evaporation of the processing bath in this way when no photographic material 36 is being transported.

Moreover, in this embodiment the transporting entry port 35 and the transporting exit port 37 are closed by reversing the motor 55 and moving the movable lid 46 to the left in FIG. 1, but the transporting entry and exit ports 35 and 37 may be closed by the action of a spring, for example, upon the movable lid 46 to move it to the left hand side in FIG. 1.

In this embodiment, a one-way clutch, for example, must be arranged between the shaft 50 and the sprocket 51 so that the rotation is not transmitted to the motor when the shaft is rotated in the reverse direction by the spring.

EMBODIMENT 2

Embodiment 2 is described below with reference to FIGS. 6 and 7.

In embodiment 2, the transmission mechanism by which the driving force which turns the shaft 50 is transmitted to the movable lid 46 is different, but the apparatus is otherwise the same as that in embodiment 1.

Figure 6:
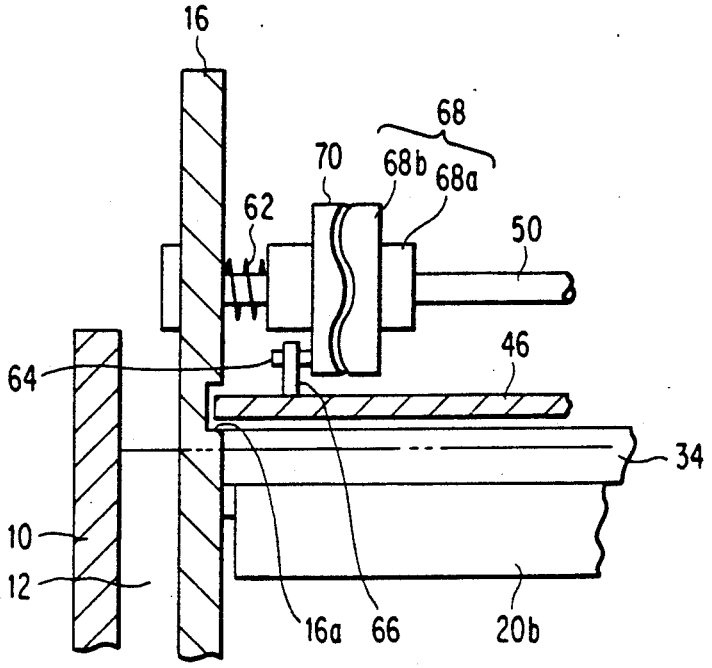
FIG. 6 is a cross sectional view corresponding to FIG. 3, showing a second example.

As shown in FIG. 6, the fixed flange 68 is fitted onto the shaft 50. This fixed flange 68 is formed from the fitting part 68*a* which is fitted to the shaft 50 and a wide diameter part 68*b* of larger diameter than the fitting part 68*a*. The end surface of the wide diameter part 68*b* facing the side plate 16 has an uneven form with gently sloping surfaces. The movable flange 70 of which the end surface has an uneven form corresponding to the uneven form of the wide diameter part 68*b* is supported axially on the shaft 50 and arranged between the fixed flange 68 and the side plate 16. This flange 70 is pressed against the fixed flange 68 by the spring force of the compression coil spring 62. Furthermore, the pin 64 of the movable flange 70 is inserted between a pair of protrusions 66 which are established on the movable lid 46 in the same manner as in embodiment 1.

When the driving force is transmitted to the shaft 50 and the shaft rotates, the movable flange 70 is rotated by the fixed flange 68, and the movable lid 46 is moved by the rotation of the movable flange. The rotation of the movable flange 70 is stopped when the movable lid 46 makes contact with the stopper 32*a* of the block 32.

Figure 7:
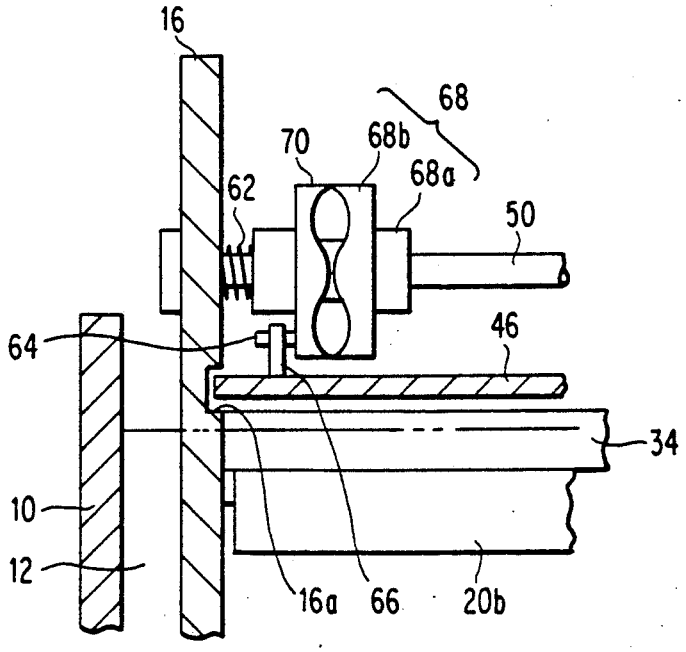
FIG. 7 is an operating diagram indicating the operation of FIG. 6, showing a second example.

However, the driving force is still being applied to the shaft 50 and so the fixed flange 68 continues to rotate, and as the rotation proceeds, the convex parts of the fixed flange 68 slide up the gently inclined surfaces out of the concave parts of the movable flange 70, and then the movable flange 70 is moved towards the side plate 16 against the spring force of the compression coil spring 62 (see FIG. 7). Hence, the fixed flange 68 rotates while imposing a force in the counter-clockwise direction in FIG. 1 on the movable flange 70 by the rotating drive force of the flange 50. The movable lid 46 can be maintained in the open state in this way. Furthermore, the motor 55 is reversed and the movable lid 46 is moved to the left in FIG. 1 to close the transporting entry port 35 and the transporting exit port 37. When the movable lid 46 makes contact with the stopper 38*a* of the block 38, the convex parts of the fixed flange 68 slide up the gently inclined surfaces out of the concave parts of the movable flange 70 in the same way as in the open state, and the movable lid 46 can be maintained in the closed state.

No friction materials are used in embodiment 2 and so the number of parts is less than that in embodiment 1.

EMBODIMENT 3

Embodiment 3 is described below with reference to FIGS. 8 and 9.

In embodiment 3, the transmission mechanism by which the driving force which turns the shaft 50 is transmitted to the movable lid 46 is different from that in embodiment 1, but otherwise the apparatus is the same as in embodiment 1.

Figure 8:
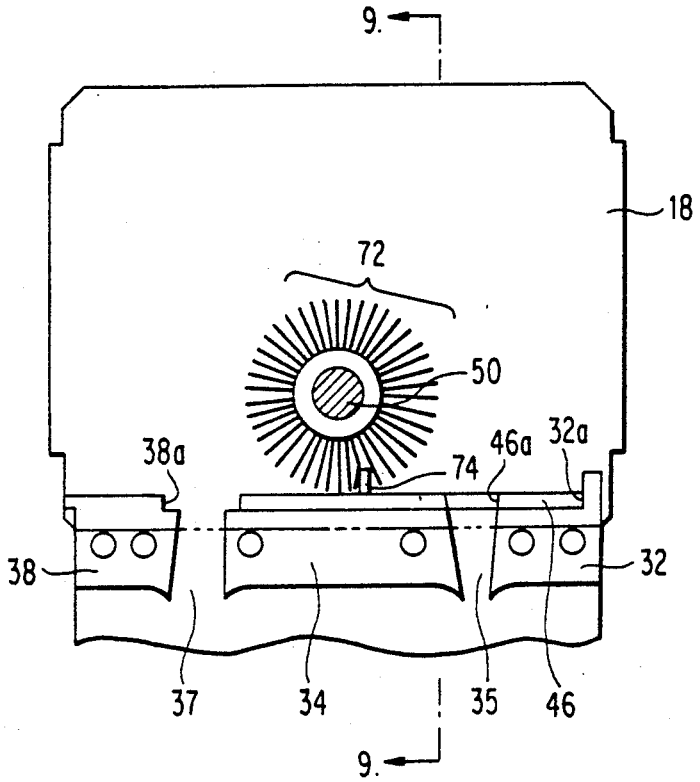
FIG. 8 is a cross sectional view corresponding to FIG. 1, showing a third example.
Figure 9:
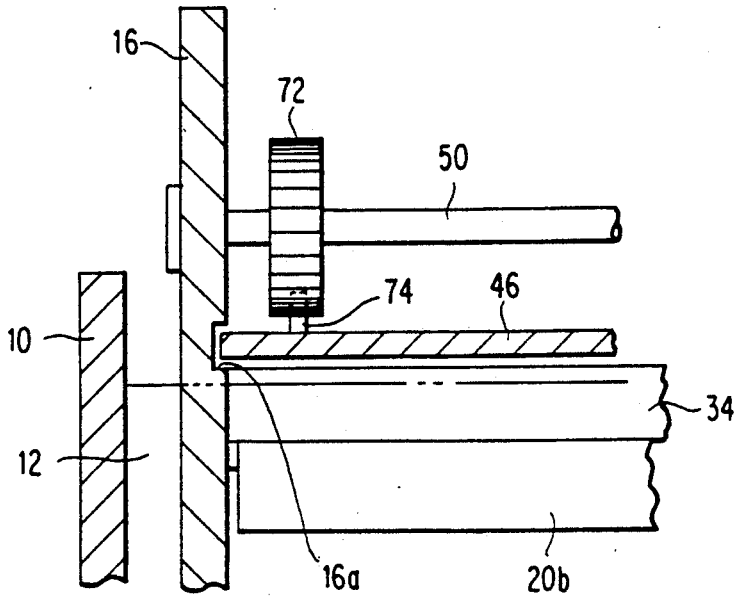
FIG. 9 is a cut-away cross sectional view along the line IX—IX in FIG. 8, showing a third In these drawings.

As shown in FIG. 8, a plurality of blades 72 are fitted radially about the shaft 50. These blades 72 are elastic in nature.

The protrusion 74 is established on the movable cover 46 so that the tips of the blades 72 make contact with the protrusion.

The blades 72 are rotated in the counterclockwise direction in FIG. 8 by the driving force which turns the shaft 50. As a result of this rotation, the tips of the blades make contact with the protrusion 72, the movable lid 46 is moved and the open state (the state shown in FIG. 8) is achieved. In this state, the movable lid 46 is in contact with the stopper 32*a* of the block 32, the blades 72 make contact with the protrusion 74 and their rotation is prevented but, since they are elastic, they are able to ride over the protrusion 74. This operation can be carried out continuously and the movable lid 46 is retained in the open state.

Furthermore, when the transporting entry port 35 and the transporting exit port 37 are set in the closed state, the motor 55 is reversed and the movable lid 46 is moved to the left in FIG. 8. As a result of this, the movable lid 46 makes contact with the stopper 38*a* of the block 38 and rotation of the blades 72 is prevented but, because they are elastic they ride over the protrusion 74. The movable lid 46 can be maintained in a closed state by continuing this operation.

In embodiment 3, no use is made of a fixed flange, a movable flange and a compression coil spring, etc., and so the apparatus has even fewer parts than in embodiment 2.

The bleach-fixing baths which are used in the present invention are described below.

Aminopolycarboxylic acids, aminopolyphosphonic acids, organic carboxylic acids, and organic phosphonic acids can be employed as effective organic acids for forming the organic acid ferric complex salts which are used in the present invention. Actual examples of such organic acids include ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, methyliminodiacetic acid, iminodiacetic acid and glycol ether diaminetetraacetic acid.

These compounds may take the form of sodium, potassium, lithium or ammonium salts. Of these compounds, the ferric complex salts (i.e., the iron(III) complex salts) of ethylenediaminetetraacetic acid, diethylenetriaminepentaacetic acid, cyclohexanediaminetetraacetic acid, 1,3-diaminopropanetetraacetic acid and methyliminodiacetic acid are preferred in view of their high bleaching ability.

These ferric ion complex salts can be used in the form of complex salts, or they may be formed in solution using ferric sulfate, ferric chloride, ferric nitrate, ferric ammonium sulfate or ferric phosphate, etc., and chelating agents such as an aminopolycarboxylic acid, aminopolyphosphonic acid or phosphonocarboxylic acid. Furthermore, the chelating agent may be used in excess of that required to form the ferric ion complex salt. Of the iron complexes, the aminopolycarboxylic acid iron complex salts are preferred, and the amount of the organic acid ferric complex salt employed is from 0.01 to 1.0 mol, and preferably from 0.05 to 0.50 mol, per liter of the bleach-fixing bath.

The sulfinic acids which can be used in the bleach-fixing baths of the present invention are described below.

The sulfinic acids which are included in the bleach-fixing baths of the present invention are compounds in which at least one —$SO_2H$ group is bonded to an aliphatic group, an aromatic group or a heterocyclic group.

Here, an aliphatic group signifies a linear chain, branched chain or cyclic alkyl group, alkenyl group or alkynyl group, and these groups may be substituted with substituent groups (for example, ethyl, t-butyl, sec-amyl, cyclohexyl, benzyl). Furthermore, the aromatic groups may be either carbocyclic aromatic groups (for example, phenyl, naphthyl) or heterocyclic aromatic groups (for example, furyl, thienyl, pyrazolyl, pyridyl, indolyl), and they may consist of single ring systems or condensed ring systems (for example, benzofuryl, phenanthrolidinyl). These aromatic groups may have substituent groups.

The above-mentioned heterocyclic groups are preferably groups which have a 3- to 10-membered ring structure made up of carbon atoms, oxygen atoms, nitrogen atoms, sulfur atoms and hydrogen atoms, and the heterocyclic ring itself may be a saturated ring or an unsaturated ring. Moreover, the heterocyclic ring may be substituted with substituent groups (for example, cumanyl, pyrrolidyl, pyrrolinyl, morpholinyl). The alkali metal, alkaline earth metal, nitrogen-containing base or ammonium salts of the above-mentioned sulfinic acids can be used as the sulfinic acid salts which are used in the present invention. Here, Na, K, or Li, for example, can be used as the alkali metal and Ca and Ba, for example, can be used as the alkaline earth metals. Furthermore, the usual amines which can form salts with sulfinic acids can be used as nitrogen-containing bases.

Moreover, where there is a plurality of —$SO_2H$ groups in the molecule, compounds in which some or all of these groups are in the form of salts are also included.

Compounds in which the —$SO_2H$ group is bonded to an aromatic group or a heterocyclic ring are preferred for the above-mentioned sulfinic acids from the point of view of their antistaining effect, and the alkali metal, alkaline earth metal, nitrogen containing organic base or ammonium salts are preferred. Moreover, compounds in which the —$SO_2H$ group is bonded to an aromatic group are especially desirable, and of these the alkali metal or alkaline earth metal salts are preferred. In other words, alkali metal or alkaline earth metal aromatic sulfinate are preferred.

Moreover, where the —$SO_2H$ group is bonded to a phenyl group, the preferred combinations of groups substituted on the phenyl group are those in which the sum of the Hammett $\sigma$ value is at least 0.0.

On the other hand, from the point of view of their solubility to water, the sulfinic acids may have a number of hydrophilic substituent groups, but sulfinic acids, salts and precursors thereof which have 20 carbon atoms or less and more preferably have from 1 to 15 carbon atoms, are preferred.

Specific example of sulfinic acids and sulfinic acid salts which can be used in the present invention are listed below.

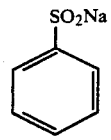

S-1

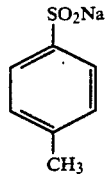

S-2

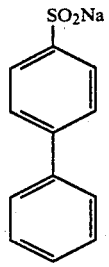

S-3

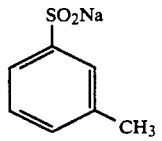

S-4

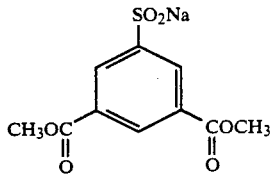

S-5

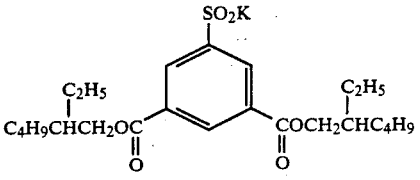

S-6

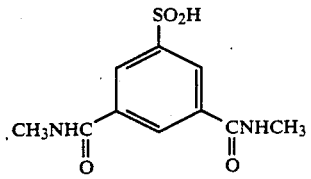

S-7

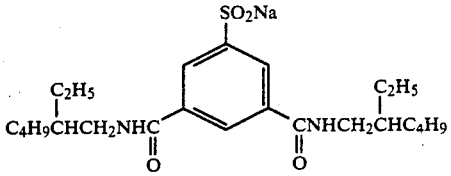

S-8

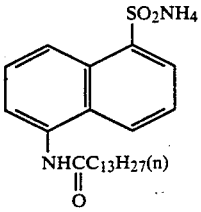

S-9

-continued
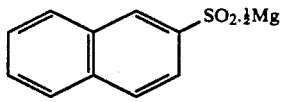
S-10
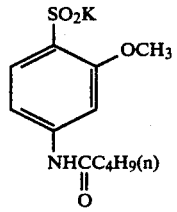
S-11
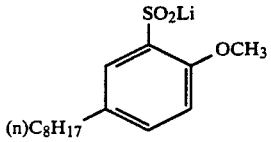
S-12
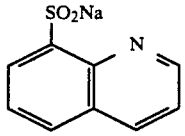
S-13
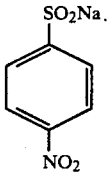
S-14
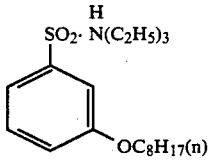
S-15
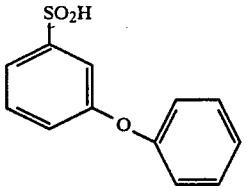
S-16
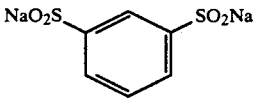
S-17
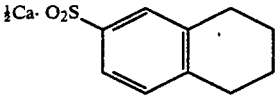
S-18
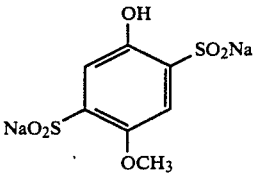
S-19
-continued
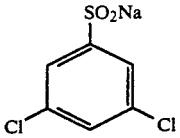
S-20
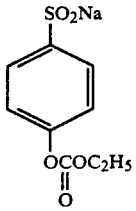
S-21
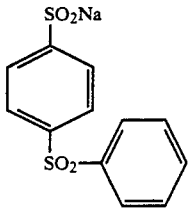
S-22
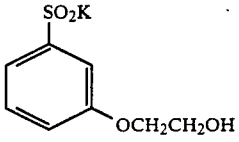
S-23
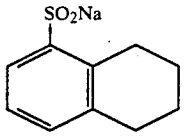
S-24
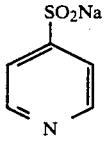
S-25
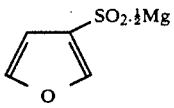
S-26
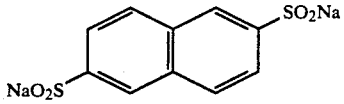
S-27
$^{(n)}C_4H_9SO_2Na$
S-28
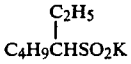
S-29
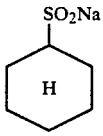
S-30
$CH_3OCH_2CH_2OCH_2CH_2SO_2NH_4$
S-31

-continued

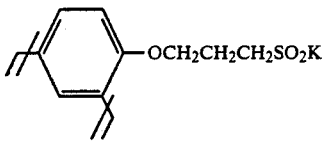

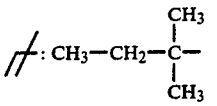

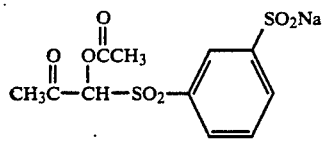

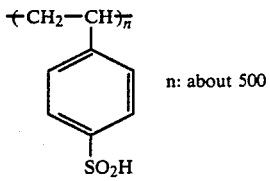

n: about 500

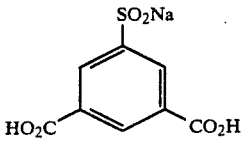

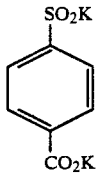

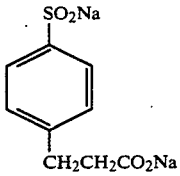

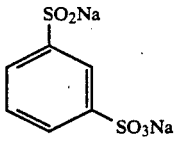

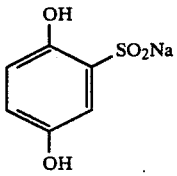

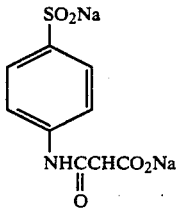

-continued

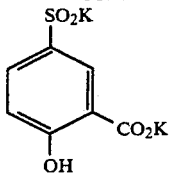

The above-mentioned compounds can be used individually, or mixtures of two or more types can be used, if desired.

Among the above-mentioned compounds, S-1, S-2, S-4, S-10, S-14, S-17, S-25, S-30, S-35, S-36, S-37 and S-38 are preferred. Particularly, S-35, S-36, S-37 and S-38 are preferred.

The above-mentioned sulfinic acids can be prepared, for example, using the method disclosed in U.S. Pat. No. 4,770,987, and the methods based thereon.

In the present invention, the sulfinic acid or salt thereof may be present in the bleach-fixing bath in an amount of from 0.05 to 100 g and preferably in an amount of from 0.1 to 50 g, per liter of the bleach-fixing bath.

Photographic processing baths which can be used in the present invention, and the processes involved, are described below.

Color Developing Baths (Color Developing Solutions)

Known primary aromatic amine color developing agents can be present in the color developing baths used in the present invention. The use of p-phenylenediamine derivatives is preferred, and specific examples are indicated below, but the present invention is not to be construed as limited to the use of these compounds.

D- 1: N,N-Diethyl-p-phenylenediamine
D- 2: 2-Amino-5-diethylaminotoluene
D- 3: 2-Amino-5-(N-ethyl-N-laurylamino)toluene
D- 4: 4-[N-Ethyl-N-(β-hydroxyethyl)amino]aniline
D- 5: 2-Methyl-4-[N-ethyl-N-(β-hydroxyethyl-)amino]aniline
D- 6: 4-Amino-3-methyl-N-ethyl-N-[β-(methanesulfonamido)ethyl]aniline
D- 7: N-(2-Amino-5-diethylaminophenylethyl)methanesulfonamide
D- 8: N,N-Dimethyl-p-phenylenediamine
D- 9: 4-Amino-3-methyl-N-ethyl-N-methoxyethylaniline
D-10: 4-Amino-3-methyl-N-ethyl-N-β-ethoxyethylaniline
D-11: 4-Amino-3-methyl-N-ethyl-N-β-butoxyethylaniline Among these, D-4, D-5 and D-6 are preferred.

Furthermore, these p-phenylenediamine derivatives can be in the form of their sulfate, hydrochloride, sulfite or p-toluenesulfonate salts, for example. The primary aromatic amine developing agents are preferably used at a concentration of from about 0.1 g to about 20 g per liter of the developing bath, and most preferably at a concentration of from about 0.5 g to about 10 g per liter of the developing bath.

A number of compounds, starting with the compounds disclosed in JP-A-62-215272, can be used as preservatives for the color developing bath. The use of the organic preservatives indicated below is especially preferable. For example, hydroxylamines (excluding hydroxylamine per se), hydroxamic acids, hydrazines, hydrazides, phenols, α-hydroxyketones, α-aminoketones, sugars, monoamines, diamines, polyamines, quaternary ammonium salts, nitroxy radicals, alcohols, oximes, diamide compounds and condensed cyclic amines are especially effective organic preservatives. These compounds are disclosed, for example, in JP-A-63-4235, JP-A-63-30845, JP-A-63-21647, JP-A-63-44655, JP-A-63-53551, JP-A-63-43140, JP-A-63-56654, JP-A-63-58346, JP-A-63-43138, JP-A-63-44657, JP-A-63-44656, European Patent 254280, U.S. Pat. Nos. 3,615,503 and 2,494,903, JP-A-52-143020 and JP-B-48-30496 (the term "JP-B" as used herein refers to an "examined Japanese patent publication").

The amount of such compounds present in the color developing baths is from 0.005 to 0.5 mol/liter, and preferably from 0.03 to 0.1 mol/liter.

Furthermore, sulfites such as sodium sulfite, potassium sulfite, sodium bisulfite, potassium bisulfite, sodium metabisulfite and potassium metabisulfite, and carbonyl/sulfite adducts, can be added, as required, to the color developing bath as preservatives. However, the use of as small an amount of sulfite ion as is possible is preferred for improving the color forming properties of the color developing bath.

In practice, the sulfites are present at a concentration of preferably from 0 to 0.01 mol, more preferably of from 0 to 0.005 mol, and most preferably of 0 to 0.002 mol, per liter of the color developing bath. The smaller the amount of sodium sulfite employed the smaller the change in photographic characteristics which occurs when carrying out small scale processing as described earlier, and this is desirable.

Conventionally, the amount of hydroxylamine which is employed as a preservative has also preferably been small, for the reasons indicated above, and in practice it is used at a concentration preferably of from 0 to 0.02 mol, more preferably of from 0 to 0.01 mol, and most preferably of from 0 to 0.005 mol, per liter of the color developing bath.

The pH of the color developing baths used in the present invention is preferably from 9 to 12, and more preferably from 9 to 11.0, and other compounds which are known as developing bath components can also be present in these color developing baths.

The use of various buffers is preferred for maintaining the above-mentioned pH levels. For example, carbonates, phosphates, borates, tetraborates, hydroxybenzoates, glycine salts, N,N-dimethylglycine salts, leucine salts, norleucine salts, guanine salts, 3,4-dihydroxyphenylalanine salts, alanine salts, aminobutyric acid salts, 2-amino-2-methyl-1,3-propanediol salts, valine salts, proline salts, trishydroxyaminomethane salts and lycine salts can be used as buffers. Carbonates, phosphates, tetraborates, and hydroxybenzoates are especially excellent in terms of solubility and their buffering ability in the high pH of 9.0 or more and they have no adverse effect (such as fogging) on photographic performance when present in the color developing bath, and they have a further advantage in that they are inexpensive, and the use of these compounds as buffers is especially preferred.

Specific examples of these buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate). However, the present invention is not to be construed as limited to the use of these compounds.

The amount of the buffer added to the color developing bath is preferably at least 0.1 mol/liter, and the addition of from 0.1 to 0.4 mol/liter is especially preferred. Various chelating agents can also be used in the color developing baths to prevent the precipitation of calcium and magnesium, or to improve the stability of the developing baths.

Organic acid compounds are preferred as chelating agents, and examples of such compounds include the aminopolycarboxylic acid disclosed, for example, in JP-B-48-30496 and JP-B-44-30232, the organic phosphonic acids disclosed, for example, in JP-A-56-97347, JP-B-56-39359 and West German Patent 2,227,639, the phosphonocarboxylic acids disclosed, for example, in JP-A-52-102726, JP-A-53-42730, JP-A-54-121127, JP-A-55-126241 and JP-A-55-659506, and the other compounds disclosed, for example, in JP-A-58-195845, JP-A-58-203440 and JP-B-53-40900. Specific examples are indicated below, but the present invention is not to be construed as limited to these examples.

Nitrilotriacetic acid, diethylenetriaminepentaacetic acid, ethylenediaminetetraacetic acid, N,N,N-trimethylenephosphonic acid, ethylenediamine-N,N,N',N'-tetramethylenephosphonic acid, trans-cyclohexanediaminetetraacetic acid, 1,2-diaminopropanetetraacetic acid, glycol ether diaminetetraacetic acid, ethylenediamine-o-hydroxyphenylacetic acid, 2-phosphonobutane-1,2,4-tricarboxylic acid, 1-hydroxyethylidene-1,1-diphosphonic acid and N,N'-bis(2-hydroxybenzyl)ethylenediamine-N,N'-diacetic acid.

These chelating agents can be used alone or conjointly, if desired.

The amount of chelating agent employed should be sufficient to chelate the metal ions in the color developing bath. For example, they are generally used at concentrations of from 0.1 to 10 g per liter of the developing bath.

Developing accelerators may be employed optionally, if desired, in the color developing bath. However, it is preferred that the color developing bath of the present invention does not substantially contain benzyl alcohol in view of prevention of environmental pollution, the easy preparation of the solution and the prevention of color staining. Here, the term "does not substantially contain benzyl alcohol" means that the color developing bath contains benzyl alcohol in an amount of 2 ml or less per liter of the bath, and preferably does not contain benzyl alcohol at all.

The organic preservatives described earlier which can be used in the present invention are more effective in processing step in which color developing baths which do not substantially contain benzyl alcohol are used.

Other developing accelerators, such as the thioether based compounds described, for example, in JP-B-37-16088, JP-B-37-5987, JP-B-38-7826, JP-B-44-12380, JP-B-45-9019 and U.S. Pat. No. 3,813,247, the p-phenylenediamine based compounds described in JP-A-52-49829 and JP-A-50-15554, the quaternary ammonium salts described, for example, in JP-A-50-137726, JP-B-44-30074, JP-B-56-156826 and JP-B-52-43429, the amine based compounds disclosed, for example, in U.S. Pat. Nos. 2,494,903, 3,128,182, 4,230,796 and 3,253,919, JP-B-41-11431 and U.S. Pat. Nos. 2,482,546, 2,596,926 and 3,582,346, the polyalkylene oxides shown, for example, in JP-B-37-16088, JP-B-42-25201, U.S. Pat. No. 3,128,183, JP-B-41-11431, JP-B-42-23883 and U.S. Pat. No. 3,532,501, and 1-phenyl-3-pyrazolidones and imidazoles, can be employed, if desired.

Antifogging agents can be employed optionally, if desired, in the present invention. Thus, alkali metal halides such as sodium chloride, potassium bromide and potassium iodide, and organic antifogging agents can be used as antifogging agents. Typical examples of organic antifogging agents include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindazole and adenine.

Fluorescent whiteners are preferably present in the color developing baths used in the present invention. The use of 4,4'-diamino-2,2'-disulfostilbene based compounds as fluorescent whiteners is preferred. The amount of the whiteners employed is generally from 0 to 5 g, and preferably from 0.1 to 5 g, per liter of the developing bath.

Furthermore, various surfactants such as alkylsulfonic acids, arylsulfonic acids, aliphatic carboxylic acids and aromatic carboxylic acids, can be employed, if desired.

The processing temperature of the color developing bath in the present invention is generally from 20° C. to 50° C. and preferably from 30° C. to 40° C. The processing time is generally from 20 seconds to 6 minutes and preferably from 30 seconds to 1 minute. The replenishment rate is preferably low, and is generally within the range of from 20 to 600 ml, preferably within the range of from 30 to 300 ml, and most preferably within the range of from 30 to 120 ml, per square meter of photographic material.

The Bleach-Fixing Bath

Many compounds in addition to the bleaching agents and sulfinic acids described earlier can be used in the bleach-fixing baths of the present invention.

Various compounds can be used in the bleach-fixing bath or bleach-fixing prebath as bleaching accelerators. The compounds which have a mercapto group or a disulfide bond disclosed in U.S. Pat. No. 3,893,858, West German patent 1,290,812, JP-A-53-95630 and *Research Disclosure,* 17129 (July, 1978), the thiourea compounds disclosed, for example, in JP-B-45-8056, JP-A-52-20832, JP-A-53-32735 and U.S. Pat. No. 3,706,561, or halides such as iodide and bromide ions, for example, are preferred as bleaching accelerators in view of their excellent bleaching power.

Moreover, rehalogenating agents, such as bromides (for example, potassium bromide, sodium bromide, ammonium bromide or chlorides (for example, potassium chloride, sodium chloride, ammonium chloride) or iodides (for example, ammonium iodide) can also be present in the bleach-fixing baths which are used in the present invention. Moreover, one or more types of inorganic acid, organic acid and the alkali metal or ammonium salts thereof which have a pH buffering function, such as boric acid, borax, sodium metaborate, acetic acid, sodium acetate, sodium carbonate, potassium carbonate, phosphorous acid, phosphoric acid, sodium phosphate, citric acid, sodium citrate and tartaric acid, and anticorrosion agents, such as ammonium nitrate and guanidine, can be employed, if desired.

Known fixing agents, such as the water-soluble silver halide solvents, for example, thiosulfates such as sodium thiosulfate and ammonium thiosulfate; thiocyanates such as sodium thiocyanate and ammonium thiocyanate; thioether compounds such as ethylenebisthioglycolic acid and 3,6-dithia-1,8-octanediol; and thioureas, can be present in the bleach-fixing baths in the present invention, and one or mixtures of more than one of these compounds can be used. Furthermore, special bleach-fixing baths, etc., comprising combinations of large amounts of halides such as potassium iodide and the fixing agents disclosed in JP-A-55-155354 can also be used. The use of thiosulfates, especially ammonium thiosulfate, is preferred in the present invention. The amount of the fixing agent used is preferably from 0.3 to 3 mol, and more preferably from 0.5 to 2.0 mol, per liter of the bath which is being used. The pH of the bleach-fixing bath used in the present invention is preferably within the range of from 3 to 7, and more preferably within the range of from 5 to 7.

Furthermore, various fluorescent whiteners and antifoaming agents or surfactants, and organic solvents such as polyvinylpyrrolidone and methanol, can be present in the bleach-fixing baths.

The bleach-fixing baths in the present invention may contain compounds which release sulfite ion, such as sulfites (for example, sodium sulfite, potassium sulfite, ammonium sulfite), bisulfites (for example, ammonium bisulfite, sodium bisulfite, potassium bisulfite), metabisulfites (for example, potassium metabisulfite, sodium metabisulfite, ammonium metabisulfite), in combination with sulfinic acids as preservatives, as long as the effect of the present invention is not damaged. These compounds are preferably present at a concentration, calculated as sulfite ion, of from about 0.02 to 0.50 mol/liter, and more preferably at a concentration, calculated as sulfite ion, of from 0.04 to 0.40 mol/liter.

Further, ascorbic acid, carbonyl/sulfite adducts and carbonyl compounds, for example, can also be used as preservatives in combination with sulfites.

Moreover, buffers, fluorescent whiteners, chelating agents, antifoaming agents and fungicides, etc., can be present, if desired.

Some or all of the overflow from the water washing or stabilizing bath which is the after-bath can be introduced into the bleach-fixing baths of the present invention. The amount of overflow is generally from 10 to 500 ml, preferably from 20 to 300 ml, and most preferably from 30 to 200 ml, per square meter of photographic material.

If the amount of water washing and/or stabilizing bath which is introduced is small, the cost is reduced and the effect in reducing the amount of waste water is also small. Conversely, if the amount is too large, this has the effect of diluting the bleach-fixing bath and can give rise to desilvering failure.

Highly concentrated bleach-fixing replenishers are preferred in the present invention for reducing the amount of waste water, and the optimum bleaching agent concentration is from 0.15 to 0.40 mol/liter and the optimum fixing agent concentration is from 0.5 to 2.0 mol/liter.

The replenishment rate of the bleach-fixing replenisher is generally from 30 to 200 ml, and preferably from 40 to 100 ml, per square meter of photographic material. The bleach-fixing replenisher may involve replenishing the bleaching agent and the fixing agent separately.

The processing temperature of the bleach-fixing process in the present invention is generally from 20° C. to 50° C., and preferably from 30° C. to 40° C. The processing time is generally from 20 seconds to 2 minutes, and preferably from 30 seconds to 1 minute.

The Water Washing Process and/or Stabilizing Process

The water washing and stabilizing processes used in the present invention are described in detail below. The replenishment rate of the water washing or stabilizing process is generally from 1 to 50 times, preferably from 2 to 30 times, and more preferably from 3 to 20 times, by volume, the amount carried over from the previous bath per unit area of photographic material processed.

The above-mentioned replenishment rate of the water washing and/or stabilizing bath can be varied over a wide range depending on the application and characteristics of the photographic material (types of coupler, etc.), the temperature, the replenishment system (i.e., whether a countercurrent or cocurrent system is used) and on various other factors. Of these factors, the relationship between the number of water washing tanks in a multistage countercurrent system and the amount of water can be obtained using the method described in the *Journal of the Society of Motion Picture and Television Engineers,* Vol. 64, pages 248 to 253 (May, 1955). The normal number of stages in a multistage process is preferably from 2 to 6, and most preferably from 2 to 4.

Hence, the preferred replenishment rate per square meter of photographic material is from 300 to 1,000 ml in the case of a two-tank countercurrent system, from 100 to 500 ml in the case of a three-tank counter-current system and from 50 to 300 ml in the case of a four-tank countercurrent system. Furthermore, the carryover of the previous bath components is on the order of from 20 to 60 ml per square meter of photographic material.

Various compounds can be added to the water washing water which is used in the present invention. For example, the isothiazolone compounds and thiabendazoles disclosed in JP-A-57-8542, chlorine based disinfectants such as chlorinated sodium isocyanurate, benzotriazoles described in JP-A-61-267761, copper ions and the other disinfectants disclosed in *Chemistry of Biocides and Fungicides* by Horiguchi, *Killing Microorganisms, Biocidal and Fungicidal Techniques,* published by the Health and Hygiene Technical Society, and in *A Dictionary of Biocides and Fungicides,* published by the Japanese Biocide and Fungicide Society, can also be used.

Moreover, surfactants as wetting agents, and chelating agents as typified by EDTA as hard water softening agents, can be present in the water washing water.

Stabilization can be carried out after water washing or directly without carrying out a water washing process. Compounds which have an image stabilizing function can be employed in the stabilizing bath, and these include aldehyde compounds as typified by formaldehyde, for example, and ammonium compounds and buffers for adjusting a film pH which is suitable for dye stabilization. Furthermore, the various biocides and fungicides aforementioned can be present in order to prevent the proliferation of bacteria in the bath and to provide the photographic material with fungicidal properties after processing.

Moreover, surfactants, fluorescent whiteners and film hardening agents can also be present. In cases where, in the processing of photographic materials in accordance with the present invention, the stabilization is carried out directly without a water washing process, all of the methods disclosed, for example, in JP-A-57-8543, JP-A-58-14834 and JP-A-60-220345 can be used.

Preferred embodiments are those in which chelating agents such as 1-hydroxyethylidene-1,1-diphosphonic acid or ethylenediaminetetramethylenephosphonic acid, and magnesium or bismuth compounds are also used.

Also, the water washing process in the present invention can also be referred to as a rinsing process.

Cases in which the calcium and magnesium concentrations in the replenishers for the water washing process and/or stabilizing process in the present invention are reduced to 5 mg/liter or less are preferred.

That is to say, the calcium and magnesium concentrations in the water washing tank or stabilizing tank are naturally reduced by reducing the calcium and magnesium concentrations in the replenisher, and this suppresses the proliferation of fungi and bacteria without the use of disinfectants and biocides and, at the same time, eliminates contamination of the transporting rollers and squeegee blades in the automatic processor and the attachment of precipitates.

In the present invention, the calcium and magnesium concentrations in the replenishers for the water washing process and/or stabilizing process (referred to below as the water washing replenisher and the stabilizer replenisher) are preferably not more than 5 mg/liter, more preferably they are not more than 3 mg/liter, and most preferably they are not more than 1 mg/liter.

Various known methods can be used to set the calcium and magnesium contents of the water washing and stabilizer replenishers within the limits indicated above, but the use of ion exchange resins and/or reverse osmosis is preferred.

Various cation exchange resins can be used for the above-mentioned ion exchange resins, but the use of Na-type cation exchange resins which replace Ca and Mg with Na is preferred.

Furthermore, H-type cation exchange resins can also be used, but since the pH of the processing water is shifted to the acid side in this case, these resins are preferably used together with OH-type anion exchange resins.

Moreover, the aforementioned ion exchange resins are preferably strongly acidic cation exchange resins based on styrene/divinylbenzene copolymers which have sulfone groups as the ion exchange groups. Examples of ion exchange resins of this type include "Diaion SK-1B" and "Diaion PK-216∞ (trade names) made by Mitsubishi Kasei Co. The base of these ion exchange resins preferably contain from 4% to 16% of divinylbenzene with respect to the total amount of monomer used in their manufacture. The anion exchange resins which can be used in combinations with the H-type cation exchange resins are preferably strongly basic anion exchange resins based on styrene/divinylbenzene copolymers which have tertiary amine or quaternary ammonium group for the exchange groups. Examples of such anion exchange resins include "Diaion SA-10A" and "Diaion PA-418" (trade names) which are also made by Mitsubishi Kasei Co.

Furthermore, reverse osmosis processing apparatus can be used to reduce the rate of replenishment of the water washing water and/or stabilizing bath in the present invention.

Any of the known types of apparatus to achieve reverse osmosis can be used in the present invention, but the use of very small apparatus in which the area of the reverse osmosis membrane is 3 $m^2$ or less and the use pressure is 30 $kg/m^2$ or less, and in which the area is preferably 2 $m^2$ or less and the use pressure is preferably 20 $kg/m^2$ or less, is most preferred. If a small scale apparatus of this type is used, the operability is good and adequate water economy can be obtained. Moreover, the liquids can be passed through active carbon and magnetic fields, etc.

Moreover, cellulose acetate films, ethyl cellulose films, poly(acrylic acid) films, polyacrylonitrile films, poly(vinylene carbonate) films and poly(ether sulfone) films can be used, for example, as the reverse osmosis membranes used in the reverse osmosis processing apparatus.

Furthermore, a liquid feed pressure of 5 to 60 $kg/cm^2$ is normally used, but pressures of 30 $kg/cm^2$ or less are adequate for achieving the aim of the present invention, and the use of low pressure reverse osmosis apparatus with a pressure of 10 $kg/m^2$ or less is satisfactory.

Use can be made of spiral, tubular, hollow fiber, pleated and rod type reverse osmosis membranes.

Moreover, the liquid in at least one tank selected from the water washing tanks and stabilization tanks or the replenishment tanks thereof can be irradiated with ultraviolet light in the present invention, and the proliferation of fungi can be suppressed considerably in this way.

Low pressure mercury vapor lamps which have a line spectrum of wavelength 253.7 nm can be used as the ultraviolet lamps which are used in the present invention. The use of lamps which have a biocidal line output of from 0.5 w to 7.5 w is especially desirable in the present invention.

The ultraviolet lamp can be installed outside the liquid for irradiation purposes, or it may be installed within the liquid.

With the present invention, no disinfectants and fungicides need be present in the water washing and/or stabilizer replenishers, but they may be used where their use has no effect on the performance of the preceding baths.

The pH of the water washing or stabilizing baths is normally from 4 to 9, and preferably from 5 to 8. However, there are also cases in which an acidic stabilizing bath (pH 4 or less) to which acetic acid, for example, has been added may be used, depending on the particular application and purpose.

The water washing and/or stabilizing process time is indicated below.

The water washing or stabilizing process time in the present invention is from 10 seconds to 4 minutes, but a shorter time is preferred for more fully realizing the effect of the present invention, and in practice the water washing or stabilizing process time is from 20 seconds to 3 minutes, and more preferably from 20 seconds to 2 minutes.

The incorporation of various cleaning promoting devices is desirable in the water washing or stabilizing processes. Thus, ultrasonic vibrations in the bath, air bubbling, impinging jets on the surface of the photographic material and compression with rollers can be used, for example, as such a means of promoting cleaning. Furthermore, the temperature in the water washing or stabilizing process is generally within the range of from 20° C. to 50° C., preferably within the range of from 25° C. to 45° C., and more preferably within the range of from 30° C. to 40° C.

The overflow of the water washing and/or stabilizing process is defined as the out-flow from the tank which accompanies replenishment, and various methods can be adopted for introducing this overflow into an earlier bath. For example, methods in which a slit is present in the upper part of the wall adjacent to the previous bath in the automatic processor and the overflow is introduced through this slit, or methods in which the overflow is collected outside the automatic processor and then supplied using a pump can be used for this purpose.

By introducing the overflow into a previous bath in this way, smaller volumes of more concentrated replenishers can be added to the previous bath. Thus, the bath components can be maintained at the required concentrations and the volume of waste water can be reduced effectively by concentrating the previous bath replenisher.

Of course, the overflow can be stored in a liquid holding tank and then the replenisher components may be added to this liquid which can then be used as finished replenisher with the same effect.

Furthermore, the overflow also contains the carried over components of the previous bath and so the absolute amounts of the components replenished to the previous bath can be reduced by using the overflow, and this can reduce the pollution loading and the processing cost.

The amount of overflow introduced into the previous bath can be set optionally so as to provide good control of the previous bath concentration, but normally the ratio of the amount of overflow liquid admixed with respect to the replenishment rate of the previous bath is set within the range of from 0.2 to 5, preferably within the range of from 0.3 to 3, and more preferably within the range of from 0.5 to 2.

Where the water washing water replenisher or the replenisher for the stabilizing bath, which is used in place of water washing, is added to the color developing bath, it is desirable that the water washing water replenisher or stabilizing bath replenisher, which is used in place of water washing, should not contain compounds which release ammonium ions, such as ammonium chloride or aqueous ammonia. This is in order to prevent any reduction in photographic performance.

The color developing process which is applied to the present invention is a color developing process comprising a bleach-fixing process and a water washing process or a stabilizing process which is used in place of the water washing process, which is continuously carried out after the bleach-fixing process in a continuous process using an automatic processor.

Specific embodiments of the processing operations of the present invention are indicated below, but the processes of the present invention are not to be construed as limited by these examples.

1. Color Development→Bleaching→(Water Washing)→Bleach-Fixing→(Water Washing)→(Stabilization)
2. Color Development→Bleach-Fixing→(Water Washing)→(Stabilization)
3. Color Development→Bleaching→Bleach-Fixing→(Water Washing)→(Stabilization)
4. Color Development→Bleach-Fixing→Bleach-Fixing→(Water Washing)→(Stabilization)
5. Color Development→Bleaching→Fixing→Bleach→Fixing→(Water Washing)→(Stabilization)

6. Color Development→Fixing→Bleach-Fixing→(Water Washing)
7. Color Development→Fixing→Bleach-Fixing→Bleach-Fixing →(Water Washing)

The processes in parentheses may be omitted, depending on the type of material, its purpose and its application, but water washing and stabilization which are continuously carried out after a bleach-fixing process cannot both be omitted at the same time. Furthermore, the water washing processes can be replaced by stabilizing processes. Furthermore, the present invention can also be applied effectively to color reversal processing.

The present invention is also generally effective for the processing of both negative type and positive type photographic materials.

The internal latent image type silver halide emulsions which have not been prefogged which can be used in the present invention are silver halide emulsions in which the surfaces of the silver halide grains have not been prefogged and in which the latent image is formed principally within the grains. Specific examples of internal latent image type emulsion include the conversion type silver halide emulsions disclosed, for example, in the specification of U.S. Pat. No. 2,592,250 and the core/shell type silver halide emulsions disclosed in U.S. Pat. Nos. 3,761,276, 3,850,637, 3,923,513, 4,035,185, 4,395,478 and 4,504,570, JP-A-52-156614, JP-A-55-127549, JP-A-53-60222, JP-A-56-22681, JP-A-59-208540, JP-A-60-107641, JP-A-61-3137, JP-A-62-215272 and patents listed on page 236 of *Research Disclosure,* 23510 (published November, 1983).

The form of the silver halide grains in the internal latent image type emulsions used in the present invention may be a regular crystalline form such as a cubic, octahedral, dodecahedral or tetradecahedral form, or an irregular form such as a spherical form, and grains which have a tabular form in which the value of the length/thickness ratio is at least 5 may also be used. Furthermore, grains which have a composite form comprised of these forms, and emulsions comprised of mixtures of these forms, may also be used.

The composition of the silver halide of the internal latent image type emulsions is that of a silver chloride, silver bromide, or mixed silver halide, and it is preferably that of a silver (iodo)bromide, silver (iodo)chloride or silver (iodo)chlorobromide which is substantially silver iodide free, i.e., contains not more than 3 mol% of silver iodide. The average grain size of silver halide grains in the internal latent image type emulsion is preferably from 0.1 μm to 2 μm and more preferably from 0.15 μm to 1 μm. The grain size distribution may be narrow or wide, but the so-called "monodisperse" silver halide emulsions in which the grain size distribution is such that at least 90% of all the grains in terms of the number of grains or by weight are of a size within ±40%, and preferably within ±20%, of the average grain size are preferred for improving graininess and sharpness, etc. Two or more types of monodisperse silver halide emulsion which have different grain sizes or pluralities of grains which have the same grain size but different sensitivities can be used as mixtures in the same layer or, by lamination coating, in separate layers in emulsion layers which have essentially the same color sensitivity, and two or more types of polydisperse silver halide emulsion or combinations of monodisperse and polydisperse emulsions can be used similarly in the form of mixtures or as laminates.

The internal latent image type silver halide emulsions used in the present invention can be chemically sensitized, either internally or at the surface using sulfur or selenium sensitization, reduction sensitization or noble metal sensitization, for example, either individually or conjointly. Detailed examples are disclosed in the patents described on page 23 of *Research Disclosure,* 17643-III (published December, 1978), for example.

All of the compounds used for the purpose of nucleating internal latent image type silver halide emulsions in the past can be used as the nucleating agents which can be used in the present invention. Combinations of two or more types of nucleating agents can be used conjointly. More precisely, the hydrazine based compounds and the quaternary heterocyclic compounds disclosed, for example, in *Research Disclosure,* 22534 (published January, 1983, pages 50 to 54), *Research Disclosure,* 15162 (published November, 1976, pages 76 to 77) and *Research Disclosure,* 23510 (published November, 1983, pages 346 to 352) can be used as nucleating agents.

These are described in detail in JP-A-63-74056, pages 372 to 375.

The nucleating agents used in the present invention can be present in the photographic material or in the processing baths for the photographic material, and they are preferably present in the photographic material.

When included in the photographic material, the nucleating agents are preferably present in the internal latent image type silver halide emulsion layers, but they may be present in other layers, such as interlayers, undercoating layers or backing layers, provided that they can diffuse during coating or processing and be adsorbed on the silver halide. When the nucleating agent is present in a processing bath, it may be present in a prebath having a low pH as disclosed in JP-A-58-178350.

Where the nucleating agent is present in the photographic material, the amount of the nucleating agent used is preferably from $1\times10^{-8}$ to $1\times10^{-2}$ mol, and more preferably from $1\times10^{-7}$ to $1\times10^{-3}$ mol, per mol of the silver halide.

Furthermore, where the nucleating agent is present in a processing bath, the amount used is preferably from $1\times10^{-5}$ to $1\times10^{-1}$ mol, and more preferably from $1\times10^{-4}$ to $1\times10^{-2}$ mol, per liter of the processing bath.

The compounds indicated below may be added in order to increase the maximum image density, to reduce the minimum image density, to improve the storage properties of the photographic material or to speed up development, for example.

Hydroquinones (for example, the compounds disclosed in U.S. Pat. Nos. 3,227,552 and 4,279,987); chromans (for example, the compounds disclosed in U.S. Pat. No. 4,268,621, JP-A-54-103031 and on pages 333 and 334 of *Research Disclosure,* No. 18264 (published June, 1979)); quinones (for example, the compounds disclosed on pages 433 and 434 of *Research Disclosure,* No. 21206 (December, 1981)); amines (for example, the compounds disclosed in U.S. Pat. No. 4,150,993 and JP-A-58-174757); oxidizing agents (for example, the compounds disclosed in JP-A-60-260039 and on pages 10 and 11 of *Research Disclosure,* No. 16936 (published May, 1978)); catechols (for example, the compounds disclosed in JP-A-55-21013 and JP-A-55-65944); compounds which release nucleating agents during development (for example, the compounds disclosed in JP-A-60-107029); thioureas (for example, the compounds disclosed in JP-A-60-95533); and spirobisindanes (for example, the compounds disclosed in JP-A-55-65944).

The tetraazaindenes, triazaindenes and pentaazaindenes which have at least one mercapto group, which may optionally be substituted with an alkali metal atom or an ammonium group, and the compounds disclosed in JP-A-61-136948 (pages 2 to 6 and pages 16 to 43), JP-A-63-106656 (pages 12 to 43) and JP-A-63-8740 (pages 10 to 29) can be employed as nucleating accelerators which can be used in the present invention.

The nucleating accelerators in this case are preferably added to the silver halide emulsion layer or a layer which is adjacent the silver halide emulsion layer.

The amount of nucleating accelerator employed is preferably from $1\times10^{-6}$ to $1\times10^{-2}$ mol, and more preferably from $1\times10^{-5}$ to $1\times10^{-2}$ mol, per mol of the silver halide.

Furthermore, where the nucleating accelerator is present in a processing bath, which is to say in the developing bath or in the developing prebath, it is present at a concentration, preferably, of from $1\times10^{-8}$ to $1\times10^{-3}$ mol, and, more preferably, of from $1\times10^{-7}$ to $1\times10^{-4}$ mol, per liter of bath.

Two or more types of nucleation accelerator can also be used conjointly, if desired.

The silver halide composition of negative type silver halide emulsions used in the present invention may be silver chlorobromide, silver iodochlorobromide, silver bromide, or silver iodobromide provided that the silver bromide content is at least 20 mol%, but the use of substantially silver iodide-free silver chlorobromides is especially desirable.

The form of the silver chlorobromide grains of a negative type emulsion may be tetradecahedral or rhombododecahedral as well as cubic or octahedral, etc., as described earlier, or it may have some other form. In the case of junction type grains, in particular, the use of grains which are not of indeterminate form but which have a regular grain form obtained by forming junction crystals uniformly on the corners and edges, or on the surfaces, of host grains is preferred. Furthermore, they may have a spherical form. The use of octahedral grains or tetradecahedral grains is preferred. Furthermore, the use of cubic grains is particularly preferred. Tabular grains can also be used, but emulsions in which tabular grains of which the ratio of the grain diameter for a calculated circle with respect to the grain thickness has a value of from 5 to 8 account for at least 50 mol% of the projected area of all the grains are useful for providing rapid developing properties. The use of tabular grains of this type with the structural features as described earlier is most desirable.

The average grain size (the average of the diameters of the corresponding spheres calculated on a volume basis) of the grains of the negative type emulsion used in the present invention is preferably from 0.1 μm to 2 μm. An average grain size of from 0.15 μm to 1.4 μm is especially preferable. The grain size distribution may be narrow or wide, but monodisperse emulsions are preferred. Monodisperse emulsions of regular grains such as cubic grains which have a regular form, or tabular grains, is especially desirable in the present invention. Emulsions of this type in which the value of ratio of the standard deviation of the grain size distribution and the average grain size in terms of numbers of grains or weight is 0.2 or less, and more especially 0.15 or less, and especially 0.12 or less are preferred. With monodisperse emulsions of this type, those which contain silver halide grains which have any of the structures described earlier are especially desirable. Moreover, the use of monodisperse emulsions of this type, and especially monodisperse emulsions of grains which have a cubic, octahedral, tetradecahedral or some other regular form in the form of mixtures of laminated coatings of two or more types provides good results in respect of the adjustment of gradation of photographic materials. When mixtures of two or more types of monodisperse emulsion are used, those in which the mixing proportions in terms of the silver content are from 5% to 95% in each case are preferred.

Silver halide photographic emulsions which can be used in the negative sensitive materials and positive sensitive materials in the present invention can be prepared using the methods described, for example, in *Chemie et Physique Photographique,* by P. Glafkides, published by Paul Montel, 1967; *Photographic Emulsion Chemistry,* by G.F. Duffin, published by Focal Press, 1966; and *Making and Coating Photographic Emulsions,* by V. L. Zelikman et al., published by Focal Press, 1964, etc. That is to say, they can be prepared using the acidic method, the neutral method, the alkali method or the ammonia method, and the single jet methods, double jet methods and combinations of these methods can be used for the system by which the soluble halide is reacted with the soluble silver salt. The methods in which the grains are formed in the presence of excess silver ion (the so-called reverse mixing methods) can also be used. The so-called controlled double jet method, a method in which the silver ion concentration in the liquid phase in which the silver halide is being formed is held constant can also be used as one type of double jet method. Monodisperse silver halide emulsions in which the crystalline form of the grains is regular, as described above, and of which the grain size distribution is narrow can be obtained using this method. Grains such as those described earlier which are preferably used in the invention are preferably prepared on the basis of a double jet method.

The emulsions used have normally been subjected to physical ripening, chemical ripening and spectral sensitization. Additives used in such processes are disclosed in *Research Disclosure,* Vol. 176, No. 17643 (December, 1979) and *Research Disclosure,* Vol. 187, No. 18716 (November, 1979), and these disclosures are summarized in the table below.

Known photographically useful additives which can be used in the present invention are also disclosed in the two *Research Disclosures* mentioned above, and these disclosures are also shown in the table below.

| Type of Additive | RD 17643 | RD 18716 |
|---|---|---|
| 1. Chemical Sensitizers | Page 23 | Page 648, right column |
| 2. Speed Increasing Agents | — | Page 648, right column |
| 3. Spectral Sensitizers, Supersensitizers | Pages 23–24 | Page 648, right column to page 649, right column |
| 4. Whiteners | Page 24 | — |
| 5. Antifoggants and Stabilizers | Pages 24–25 | Page 649, right column |
| 6. Couplers | Page 25 | — |
| 7. Organic Solvents | Page 25 | — |
| 8. Light Absorbers, Filter Dyes, UV Absorbers | Pages 25–26 | Page 649, right column to page 650, left column |

-continued

| Type of Additive | RD 17643 | RD 18716 |
|---|---|---|
| 9. Antistaining Agents | Page 25, right column | Page 650, left to right columns |
| 10. Dye Image Stabilizers | Page 25 | — |
| 11. Film Hardening Agents | Page 26 | Page 651, left column |
| 12. Binders | Page 26 | Page 651, left column |
| 13. Plasticizers, Lubricants | Page 27 | Page 650, right column |
| 14. Coating Aids, Surfactants | Pages 26–27 | Page 650, right column |
| 15. Antistatic Agents | Page 27 | Page 650, right column |

Various color couplers may be used in the photographic materials which are processed in accordance with the present invention. Here, the term "color coupler" signifies a compound which can undergo a coupling reaction with the oxidant of a primary aromatic amine developing agent to form a dye. Typical examples of useful color couplers include naphthol and phenol based compounds, pyrazolone and pyrazoloazole based compounds and open chain or heterocyclic ketomethylene compounds. Typical examples of the cyan, magenta and yellow couplers which can be used in the present invention are disclosed in *Research Disclosure,* No. 17643 (December, 1978), section VII-D, and in the patents cited in *Research Disclosure,* No. 18717 (November, 1979).

The color couplers which are incorporated into the photographic materials are preferably rendered resistant to diffusion by the presence of ballast groups or by polymerization. Couplers of the type in which the colored dye has a suitable degree of diffusibility, noncolor-forming couplers or DIR couplers which release developing inhibitors as the coupling reaction proceeds, couplers which release developing accelerators, and colored couplers for correcting the unwanted absorptions on the short wavelength side can also be used.

The oil protect type acylacetamide based couplers are typical of the yellow couplers which can be used in the present invention. Specific examples are disclosed in U.S. Pat. Nos. 2,407,210, 2,875,057 and 3,265,506. The use of 2-equivalent yellow couplers is preferred in the present invention, and typical examples of these couplers include the oxygen atom releasing type yellow couplers disclosed, for example, in U.S. Pat. Nos. 3,408,194, 3,447,928, 3,933,501 and 4,022,620, and the nitrogen atom releasing type yellow couplers disclosed, for example, in JP-B-58-10739, U.S. Pat. Nos. 4,401,752 and 4,326,024, *Research Disclosure,* No. 18053 (April, 1979), British Patent 1,425,020, and West German Patent Application (Laid Open) Nos. 2,219,917, 2,261,361, 2,329,587 and 2,433,812. The α-pivaloylacetanilide based couplers provide dyes which have excellent fastness, especially light fastness, and the α-benzoylacetanilide based couplers provide high color densities.

As well as the magenta couplers, oil protect type indazolone based or cyanoacetyl based, preferably 5-pyrazolone based, couplers and pyrazoloazole based couplers, which is to say those based on pyrazolotriazoles, can be used as magenta couplers in the present invention. 5-Pyrazolone based couplers which are substituted with an acylamino group or an arylamino group in the 3-position are preferred from the viewpoint of the hue of the dye which is formed and the color density, and typical examples are disclosed, for example, in U.S Pat. Nos. 2,311,082, 2,343,703, 2,600,788, 2,908,573, 3,062,653, 3,152,896 and 3,936,015. The nitrogen atom leaving groups disclosed in U.S. Pat. No. 4,310,619 or the arylthio groups disclosed in U.S. Pat. No. 4,351,897 are the preferred leaving groups for 2-equivalent 5-pyrazolone based couplers Furthermore, high color densities can be obtained with the 5-pyrazolone based couplers which have ballast groups disclosed in European Patent 73,636.

The pyrazolobenzimidazoles disclosed in U.S. Pat. No. 3,369,879, and preferably the pyrazolo[5,1-c][1,2,4]triazoles disclosed in U.S. Pat. No. 3,725,067, the pyrazolotetrazoles disclosed in Research Disclosure, No. 24220 (June, 1984) and the pyrazolopyrazoles disclosed in *Research Disclosure,* No. 24230 (June, 1984) are suitable pyrazoloazole based couplers The imidazo[1,2-b]pyrazoles disclosed in European Patent 119,741 are preferred in view of the low sub-absorbance on the yellow side and the light fastness of the colored dye, and the pyrazolo[1,5-b][1,2,4]triazoles disclosed in European Patent 119,860 are especially preferred.

The cyan couplers which can be used in the present invention include the oil protect type naphthol based and phenol based couplers, and these are typified by the naphthol based couplers disclosed in U.S. Pat. No. 2,474,293 and preferably by the 2-equivalent naphthol based couplers of the nitrogen atom releasing type disclosed in U.S. Pat. Nos. 4,052,212, 4,146,396, 4,228,233 and 4,296,200. Furthermore, specific examples of phenol based couplers are disclosed, for example, in U.S. Pat. Nos. 2,369,929, 2,801,171, 2,772,162 and 2,895,826. The use of cyan couplers which are resistant to humidity and temperature is preferred in the present invention, and typical examples include the phenol based cyan couplers which have an alkyl group comprising an ethyl or larger group in the meta-position of the phenol nucleus as disclosed in U.S. Pat. 3,772,002, the 2,5-diacylamino substituted phenol based couplers disclosed, for example, in U.S. Pat. Nos. 2,772,162, 3,758,308, 4,126,396, 4,334,011 and 4,327,173, West German Laid Open No. 3,329,729 and JP-A-59-166956, and the phenol based couplers which have a phenylureido group in the 2-position and an acylamino group in the 5-position disclosed, for example, in U.S. Pat. Nos. 3,446,622, 4,333,999, 4,451,559 and 4,427,767.

4-Equivalent couplers can also be used conjointly, as required, and couplers of which the colored dye has a suitable degree of diffusibility can be used conjointly to improve graininess. Specific examples of dye diffusible couplers of this type include the magenta couplers disclosed in U.S. Pat. No. 4,366,237 and British Patent 2,125,570, and the yellow, magenta and cyan couplers disclosed in European Patent 96,570 and West German Patent Application Laid Open No. 3,234,533.

The dye forming couplers and the aforementioned specific couplers may take the form of polymers comprising dimers or larger units. Typical examples of polymerized dye forming couplers are disclosed in U.S. Pat. Nos. 3,451,820 and 4,080,211. Specific examples of polymerized magenta couplers are disclosed in British Patent 2,102,173 and U.S. Pat. No. 4,367,282.

Two or more of each type of coupler used in the present invention can be used conjointly in the same photographic layer in order to satisfy the characteristics required of the photographic material, and the same compounds can also be introduced into two or more different layers.

The standard amount of color coupler used is within the range of from 0.001 to 1 mol per mol of sensitive silver halide, and, in the case of the yellow couplers, the preferred amount is within the range of from 0.01 to 0.5 mol per mol of sensitive silver halide. In the case of the magenta couplers, the preferred amount is within the range of from 0.003 to 0.3 mol per mol of sensitive silver halide In the case of the cyan couplers, the preferred amount is within the range of from 0.002 to 0.3 mol per mol of sensitive silver halide.

The couplers used in the present invention can be introduced into the photographic material using a variety of known dispersion methods Examples of high boiling point organic solvents which can be used in the oil-in-water dispersion method are disclosed, for example, in U.S. Pat. No. 2,322,027. Furthermore, the process and effect of the latex dispersion method and actual examples of latexes for loading purposes are disclosed, for example, in U.S. Pat. No. 4,199,363 and West German Patent Application (OLS) Nos. 2,541,274 and 2,541,230.

Anti-color-fogging agents and anti-color-mixing agents can be used in the photographic materials of the present invention.

Typical examples of these are disclosed in JP-A-62-215272, pages 600 to 663.

Color intensifiers can be used in the present invention in order to improve the color forming properties of the couplers Typical compounds are disclosed, for example, in JP-A-62-215272, pages 374 to 391.

In addition to the silver halide emulsion layers, the photographic materials preferably include auxiliary layers, such as protective layers, interlayers, filter layers, antihalation layers, backing layers and white reflecting layers.

The photographic emulsion layers and other layers in the photographic materials of the present invention can be coated onto a support as disclosed in *Research Disclosure,* No. 17643, V-VII (published December, 1978), page 28 and European Patent 0,102,253 or JP-A-61-97655. Furthermore, the coating methods disclosed in *Research Disclosure,* No. 17643, XV, pages 28 to 29, can be employed.

Color developing agents may be incorporated into the silver halide color photographic materials of the present invention in order to simplify and speed up processing. The incorporation of various color developing agent precursors is preferred.

The photographic materials in the present invention can be coated onto a flexible support such as plastic films, (cellulose nitrate, cellulose acetate, polyethylene terephthalate, for example) and papers normally used or onto rigid supports such as glass. Supports and coating methods are disclosed in *Research Disclosure,* No. 17643, Section XV (page 17) and section XVII (page 28) (December, 1978).

The use of a reflective support is preferred in the present invention. Here, a "reflective support" signifies a support which has a high reflectance and on which the dye image which has been formed in the silver halide emulsion layer is clear. Reflective supports of this type include those which are covered with a hydrophobic resin which contains a ,dispersion of a light reflecting substance such as titanium oxide, zinc oxide, calcium carbonate,calcium sulfate, etc., and those in which the support is made of a hydrophobic resin which contains a dispersion of a light reflecting substance. An underlayer is normally provided on the support. The surface of the support may also be subjected to a pretreatment such as a corona discharge, ultraviolet irradiation or flame treatment, for example, in order to improve adhesion.

ILLUSTRATIVE EXAMPLES

The present invention is described by means of the illustrative examples below.

EXAMPLE 1

A positive photographic material was prepared using the method described below (Sample 101).

This color photographic material was prepared by coating the first to the fourteenth layers indicated below onto the surface of a paper support (thickness: 100 μm) which had been laminated on both sides with polyethylene and coating the fifteenth and sixteenth layers on the reverse side of the support. Titanium oxide as a white pigment and a trace of ultramarine as a blue dye were included in the polyethylene on the side of the support on which the first layer was coated. (The chromaticity of the surface of the support in the L*, a*, b* system was 88.0, −0.20 and −0.75, respectively).

Photosensitive Layer Composition

The components and coated weights are shown below (units: g/m²). In the case of the silver halides the coated weights given are the coated weights calculated as silver. The emulsions used in each layer were prepared on the basis of the method used to prepare Emulsion EM-1. A lippmann emulsion which had not been subjected to surface chemical sensitization was used in the fourteenth layer.

| | |
|---|---|
| First Layer: Antihalation Layer | |
| Black Colloidal Silver | 0.10 |
| Gelatin | 0.70 |
| Second Layer: Interlayer | |
| Gelatin | 0.70 |
| Third Layer: Low Speed Red-Sensitive Layer | |
| Silver Bromide (average grain size: 0.25 μm, size distribution (variation coefficient): 8%, octahedral) Spectrally Sensitized with Red Sensitizing Dyes (ExS-1, ExS-2, ExS-3) | 0.04 |
| Silver Bromide (average grain size: 0.40 μm, size distribution: 10%, octahedral) Spectrally Sensitized with Red Sensitizing Dyes (ExS-1, ExS-2, ExS-3) | 0.08 |
| Gelatin | 1.00 |
| Cyan Coupler (equal weights of ExC-1, ExC-2) | 0.30 |
| Anti-Color-Fading Agent (equal weights of Cpd-1, Cpd-2, Cpd-3, Cpd-4) | 0.18 |
| Antistaining Agent (Cpd-5) | 0.003 |
| Coupler Dispersion Medium (Cpd-6) | 0.03 |
| Coupler Solvent (equal weights of Solv-1, Solv-2, Solv-3) | 0.12 |
| Fourth Layer: High Speed Red-Sensitive Layer | |
| Silver Bromide (average grain size: 0.60 μm, size distribution: 15%, octahedral) Spectrally Sensitized with Red Sensitizing Dyes (ExS-1, ExS-2, ExS-3) | 0.14 |
| Gelatin | 1.00 |
| Cyan Coupler (equal weights of ExC-1, ExC-2) | 0.30 |
| Anti-Color-Fading Agent (equal weights of Cpd-1, Cpd-2, Cpd-3, Cpd-4) | 0.18 |
| Coupler Dispersion Medium (Cpd-6) | 0.03 |
| Coupler Solvent (equal weights of Solv-1, Solv-2, Solv-3) | 0.12 |
| Fifth Layer: Interlayer | |
| Gelatin | 1.00 |
| Anti-Color-Mixing Agent (Cpd-7) | 0.08 |
| Anti-Color-Mixing Agent Solvent (equal weights of Solv-4, Solv-5) | 0.16 |

-continued

| | |
|---|---|
| Polymer Latex (Cpd-8) | 0.10 |
| Sixth Layer: Low Speed Green-Sensitive Layer | |
| Silver Bromide (average grain size: 0.25 μm, size distribution: 8%, octahedral) Spectrally Sensitized with Green Sensitizing Dye (ExS-4) | 0.04 |
| Silver Chlorobromide (AgCl content: 5 mol %, average grain size: 0.40 μm, size distribution: 10%, octahedral) Spectrally Sensitized with Green Sensitizing Dye (ExS-4) | 0.06 |
| Gelatin | 0.80 |
| Magenta Coupler (compounds shown in Table 1) | 0.11 |
| Anti-Color-Fading Agent (Cpd-9) | 0.10 |
| Antistaining Agent (Cpd-10/Cpd-11/Cpd-12/Cpd-13 = 10/7/7/1) | 0.025 |
| Coupler Dispersion Medium (Cpd-6) | 0.05 |
| Coupler Solvent (equal weights of Solv-4, Solv-6) | 0.15 |
| Seventh Layer: High Speed Green-Sensitive Layer | |
| Silver Bromide (average grain size: 0.65 μm, size distribution: 16%, octahedral) Spectrally Sensitized with Green Sensitizing Dye (ExS-4) | 0.10 |
| Gelatin | 0.80 |
| Magenta Coupler (compounds shown in Table 1) | 0.11 |
| Anti-Color-Fading Agent (Cpd-9) | 0.10 |
| Antistaining Agent (Cpd-10/Cpd-11/Cpd-12/Cpd-13 = 10/7/7/1) | 0.025 |
| Coupler Dispersion Medium (Cpd-6) | 0.05 |
| Coupler Solvent (equal weights of Solv-4, Solv-6) | 0.15 |
| Eighth Layer: Interlayer | |
| Same as the Fifth Layer. | |
| Ninth Layer: Yellow Filter Layer | |
| Yellow Colloidal Silver | 0.12 |
| Gelatin | 0.07 |
| Anti-Color-Mixing Agent (Cpd-7) | 0.03 |
| Anti-Color-Mixing Agent Solvent (equal amounts of Solv-4, Solv-5) | 0.10 |
| Polymer Latex (Cpd-8) | 0.07 |
| Tenth Layer: Interlayer | |
| Same as the Fifth Layer | |
| Eleventh Layer: Low Speed Blue-Sensitive Layer | |
| Silver Bromide (average grain size: 0.40 μm, size distribution: 8%, octahedral) Spectrally Sensitized with Blue Sensitizing Dyes (ExS-5, ExS-6) | 0.07 |
| Silver Chlorobromide (AgCl content: 8 mol %, average grain size: 0.60 μm, size distribution: 11%, octahedral) Spectrally Sensitized with Blue Sensitizing Dyes (ExS-5, ExS-6) | 0.14 |
| Gelatin | 0.80 |
| Yellow Coupler (ExY-1) | 0.35 |
| Anti-Color-Mixing Agent (Cpd-14) | 0.10 |
| Antistaining Agent (Cpd-5/Cpd-15 = 1/5) | 0.007 |
| Coupler Dispersion Medium (Cpd-6) | 0.05 |
| Coupler Solvent (Solv-2) | 0.10 |
| Twelfth Layer: High Speed Blue-Sensitive Layer | |
| Silver Bromide (average grain size: 0.85 μm, size distribution: 18%, octahedral) Spectrally Sensitized with Blue Sensitizing Dyes (ExS-5, ExS-6) | 0.15 |
| Gelatin | 0.60 |
| Yellow Coupler (ExY-1) | 0.30 |
| Anti-Color-Mixing Agent (Cpd-14) | 0.10 |
| Antistaining Agent (Cpd-5/Cpd-15 = 1/5) | 0.007 |
| Coupler Dispersion Medium (Cpd-6) | 0.05 |
| Coupler Solvent (Solv-2) | 0.10 |
| Thirteenth Layer: Ultraviolet Absorbing Layer | |
| Gelatin | 1.00 |
| Ultraviolet Absorber (equal weights of Cpd-2, Cpd-4, Cpd-16) | 0.50 |

-continued

| | |
|---|---|
| Anti-Color-Mixing Agent (equal amounts of Cpd-7, Cpd-17) | 0.03 |
| Dispersion Medium (Cpd-6) | 0.02 |
| Ultraviolet Absorber Solvent (equal amounts of Solv-2, Solv-7) | 0.08 |
| Antiirradiation Dye (Cpd-18/Cpd-19/Cpd-20/Cpd-21 = 10/10/13/15) | 0.04 |
| Fourteenth Layer: Protective Layer | |
| Fine Grained Silver Chlorobromide (AgCl content: 97 mol %, average grain size: 0.2 μm) | 0.03 |
| Acrylic Modified Copolymer of Poly(vinyl alcohol) | 0.01 |
| Poly(methyl methacrylate) Particles (average particle size: 2.4 μm) and Silicon Oxide (average particle size: 5 μm) (equal weights) | 0.05 |
| Gelatin | 1.80 |
| Gelatin Hardening Agent (equal weights of H-1 and H-2) | 0.18 |
| Fifteenth Layer: Backing Layer | |
| Gelatin | 2.50 |
| Sixteenth Layer: Back Surface Protective Layer | |
| Poly(methyl methacrylate) Particles (average particle size: 2.4 μm) and Silicon Oxide (average particle size: 5 μm) (equal weights) | 0.05 |
| Gelatin | 2.00 |
| Gelatin Hardening Agent (equal weights of H-1 and H-2) | 0.14 |

Preparation of Emulsion EM-1

Aqueous solutions of potassium bromide and silver nitrate were added simultaneously over a period of 15 minutes at 75° C. to an aqueous solution of gelatin which was being vigorously stirred and octahedral silver bromide grains of an average grain size of 0.40 μm were obtained. Next, 0.3 g of 3,4-dimethyl-1,3-thiazolin-2-thione, 6 mg of sodium thiosulfate and 7 mg of chloroauric acid (tetrahydrate) were added, sequentially, per mol of silver, to the emulsion and chemical sensitization was carried out by heating the mixture to 75° C. for a period of 80 minutes. The grains obtained in this way were then taken as core grains and grown using the same precipitation conditions as one the first occasion, and a monodisperse octahedral core/shell silver bromide emulsion having final average grain size of 0.7 μm was obtained. The variation coefficient of the grain size was about 10%. Next, 1.5 mg of sodium thiosulfate and 1.5 mg of chloroauric acid (tetrahydrate) were added, per mol of silver, to this emulsion, chemical sensitization was carried out by heating to 60° C. for 60 minutes and an internal latent image type silver halide emulsion was obtained.

ExZK-1 and ExZK-2 were used at rates of $1\times10^{-3}$ wt% and $1\times10^{-3}$ wt% with respect to the silver halide, respectively, as nucleating agents and $1\times10^{-2}$ wt% of Cpd-22 was used as a nucleating accelerator in each sensitive layer. Moreover, "Alkanol XC" (Du Pont Co.) and sodium alkylbenzenesulfonate were used as emulsification and dispersion aids, and succinic acid ester and "Magefac F-120" (Dainippon Ink Co.) were used as coating aids in each layer. Moreover, (Cpd-23, Cpd-24, Cpd-25) were used as stabilizers in the silver halide and colloidal silver containing layers. The compounds used above are shown below.

ExS-1
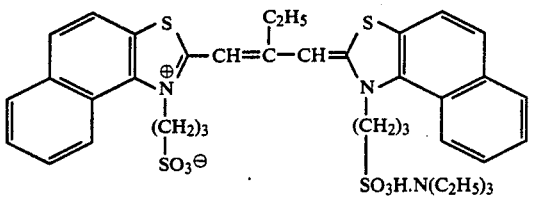
ExS-2
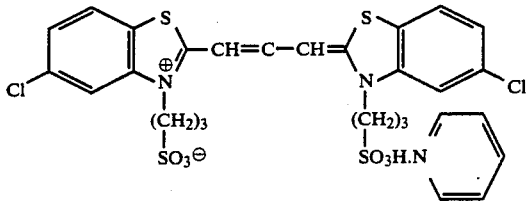
ExS-3
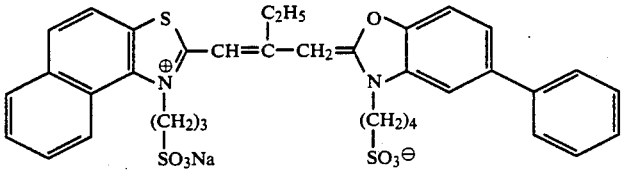
ExS-4
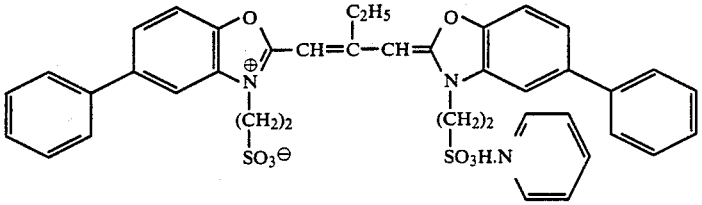
ExS-5
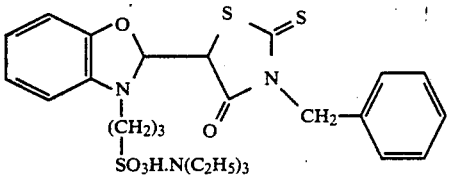
ExS-6
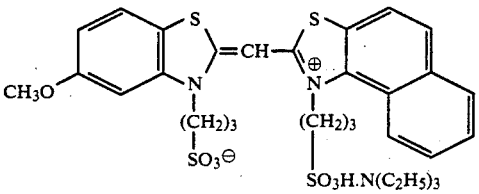
Cpd-1
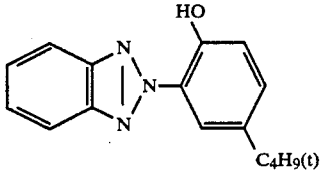
Cpd-2
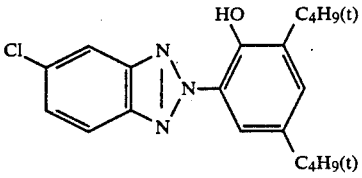
Cpd-3
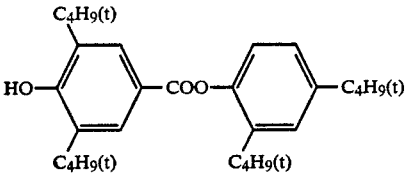
Cpd-4
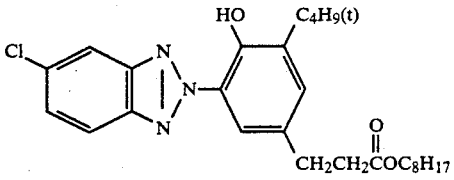
Cpd-5
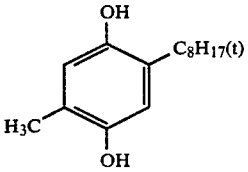
Cpd-6
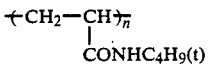
n = 100 to 1000

-continued
Cpd-7
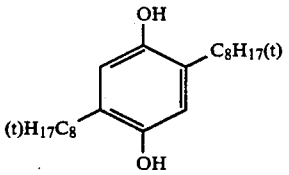
Cpd-8
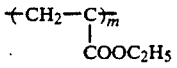
m = 100 to 1000
Cpd-9
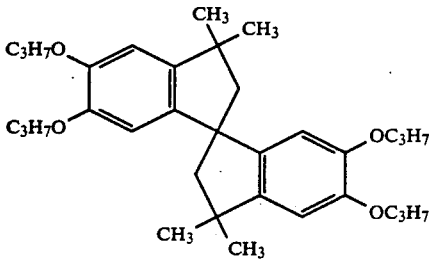
Cpd-10
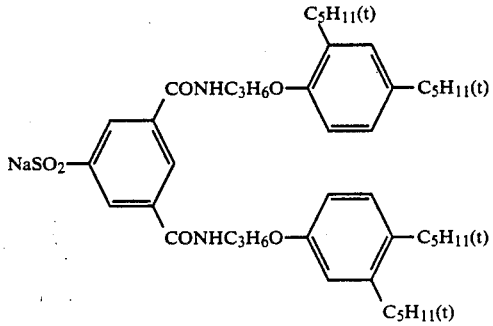
Cpd-11
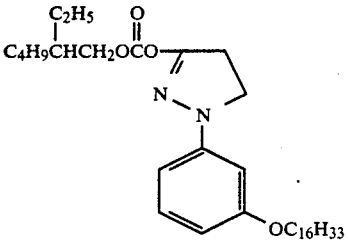
Cpd-12
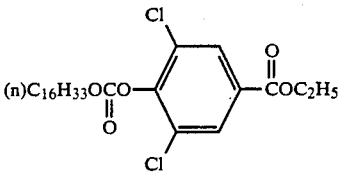
Cpd-13
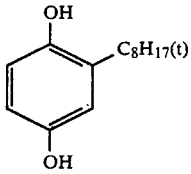
Cpd-14
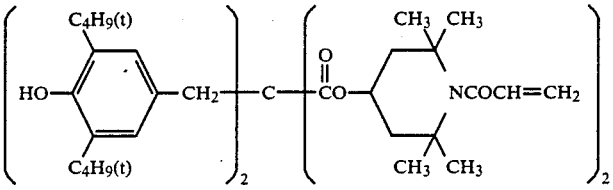
Cpd-15
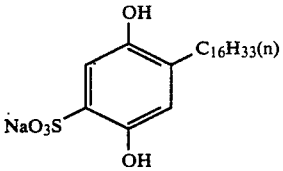
Cpd-16
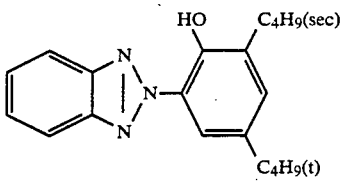
Cpd-17
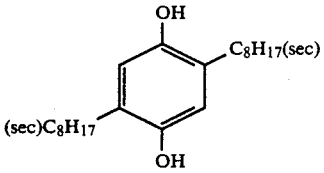
Cpd-18
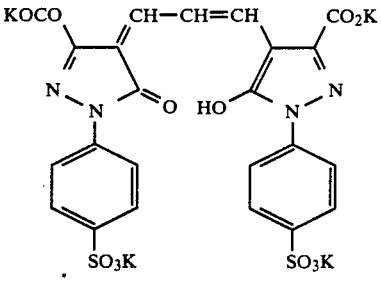
Cpd-19
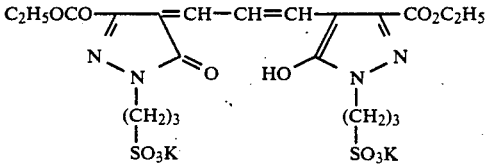

-continued
Cpd-20
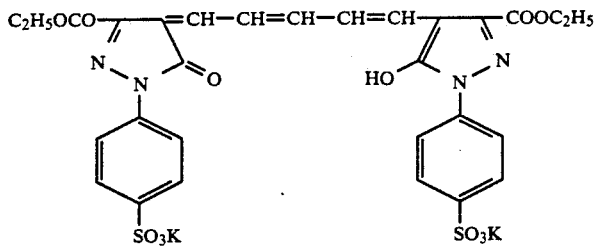
Cpd-21
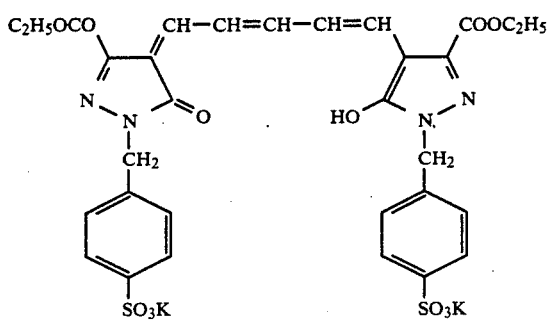
Cpd-22
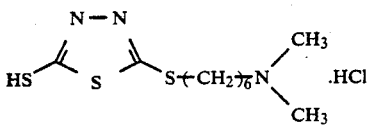
Cpd-23
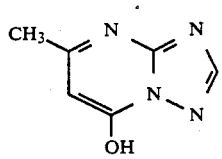
Cpd-24
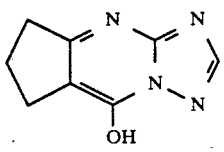
Cpd-25
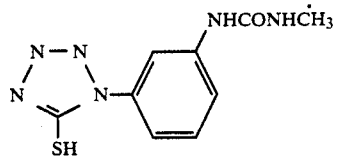
ExC-1
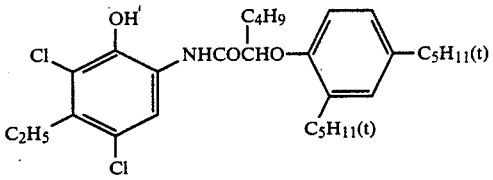
ExC-2
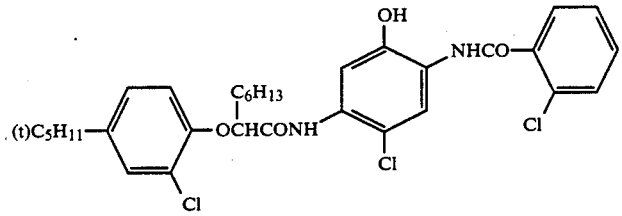
ExY-1
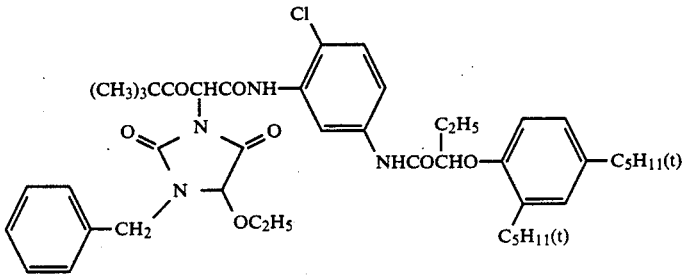
| | |
|---|---|
| Di(2-ethylhexyl) sebacate | Solv-1 |
| Trinonyl phosphate | Solv-2 |
| Di(3-methylhexyl) phthalate | Solv-3 |
| Tricresyl phosphate | Solv-4 |

-continued

| | |
|---|---|
| Dibutyl phthalate | Solv-5 |
| Trioctyl phosphate | Solv-6 |
| Di(2-ethylhexyl) phthalate | Solv-7 |
| 1,2-Bis(vinylsulfonylacetamido)ethane | H-1 |
| 4,6-Dichloro-2-hydroxy-1,3,5-triazine Na salt | H-2 |
| 7-[3-(5-Mercaptotetrazol-1-yl)benzamido]-10-propargyl-1,2,3,4-tetrahydroacridinium perchlorate | ExZK-1 |
| 1-Formyl-2-{4-[3-{[3-(5-mercaptotetrazol-1-yl)phenyl]ureido}benzenesulfonamido]phenyl}hydrazine | ExZK-2 |

Sample 101 prepared in the manner described above was subjected to imagewise exposure and then continuously processed in an automatic processor under the conditions shown below until the amount of replenisher added to the color developing bath was three times the color developing bath tank capacity.

| Processing Operation | Time (sec) | Temperature (°C.) | Mother Liquor Tank Capacity (l) | Replenishment Rate (ml/m²) |
|---|---|---|---|---|
| Color Development P1 | 135 | 38 | 15 | 300 |
| Bleach-Fixing P2 | 40 | 33 | 3 | 300 |
| Water Washing (1) PS1 | 40 | 33 | 3 | — |
| Water Washing (2) PS2 | 40 | 33 | 3 | 320 |
| Drying | 30 | 80 | | |

The water washing water replenishment system involved replenishing water washing bath (2) and conducting the overflow from water washing bath (2) to water washing bath (1) to provide a so-called counter-current replenishment system. The carry-over from the bleach-fixing bath to the water washing bath (1) by the photographic material was 35 ml/m² and so the water washing replenishment rate was 9.1 times the carry-over of bleach-fixing bath. Furthermore, the replenishment rate of the bleach-fixing bath (300 ml/m²) involved replenishment with bleach-fixing bath replenisher (B2) (225 ml/m²) and replenishment with bleach-fixing bath additive solution (B4) (75 ml/m²).

| | Mother Liquor | Replenisher |
|---|---|---|
| Color Developing Bath: | | |
| D-Sorbitol | 0.15 g | 2.20 g |
| Sodium Naphthalenesulfonate/ Formaldehyde Condensate | 0.15 g | 2.20 g |
| Ethylenediaminetetra-methylenephosphonic Acid | 1.50 g | 2.00 g |
| Diethylene Glycol | 12.0 ml | 16.0 ml |
| Benzyl Alcohol | 13.5 ml | 18.0 ml |
| Potassum Bromide | 0.70 g | — |
| Benzotriazole | 3 mg | 4 mg |
| Sodium Sulfite | 2.40 g | 3.20 g |
| N,N-(Bicarboxymethyl)-hydrazine | $4.2 \times 10^{-2}$ mol | $3.6 \times 10^{-2}$ mol |
| Triethanolamine | $4.2 \times 10^{-2}$ mol | $5.6 \times 10^{-2}$ mol |
| Glucose | $1.5 \times 10^{-2}$ mol | $2.0 \times 10^{-2}$ mol |
| N-Ethyl-N-(β-methanesulfon-amidoethyl)-3-methyl-4-aminoaniline Sulfate | 6.50 g | 8.30 g |
| Potassium Carbonate | 30.0 g | 25.0 g |
| Fluorescent Whitener (diaminostilbene based) | 1.0 g | 1.0 g |
| Water to make | 1,000 ml | 1,000 ml |
| pH (25° C.) | 10.25 | 10.75 |
| Bleach-Fixing Bath Mother Liquor: | | |
| Ethylenediaminetetraacetic Acid Disodium Salt Dihydrate | | 4.0 g |
| Ethylenediaminetetraacetic Acid Ferric Ammonium Salt Dihydrate | | 108.0 g |

-continued

| | Mother Liquor | Replenisher |
|---|---|---|
| Ammonium Thiosulfate (700 g/liter) | | 200 ml |
| Preservative (compound shown in Table 1) | | 0.12 mol |
| Sodium Bisulfite | | 20.0 g |
| 5-Mercapto-1,3,4-triazole | | 0.5 g |
| Ammonium Nitrate | | 10.0 g |
| Water to make | | 1,000 ml |
| pH (25° C.) | | 6.20 |
| Bleach-Fixing Bath Replenisher (B2): | | |
| Ethylenediaminetetraacetic Acid Disodium Salt Dihydrate | | 5.33 g |
| Ammonium Thiosulfate (700 g/liter) | | 267 ml |
| Illustrative Compound (compound shown in Table 1) | | 0.15 mol |
| Sodium Bisulfite | | 26.7 ml |
| 5-Mercapto-1,3,4-triazole | | 0.67 g |
| Water to make | | 1,000 ml |
| pH (25° C.) | | 7.00 |
| Bleach-Fixing Bath Additive Solution (B4): | | |
| Ethylenediaminetetraacetic Acid Ferric Ammonium Salt Dihydrate | | 432.0 g |
| Aqueous Ammonia (27 wt %) | | 66 g |
| Nitric Acid (67 wt % aq. soln.) | | 155 g |
| Water to make | | 1,000 ml |
| pH (25° C.) | | 1.95 |

Water Washing Water:

Both the mother liquor and the replenisher consisted of town water which had been passed through a mixed bed column which had been packed with an H-type strongly acidic cation exchange resin ("Amberlite IR-120B", made by Rohm & Haas Co.) and an OH-type anion exchange resin ("Amberlite IR-400", made by the same company) and treated in this manner to provide calcium and magnesium concentrations of not more than 3 mg/liter, after which 20 mg/liter of sodium dichloroisocyanurate and 1.5 g/liter of sodium sulfate were added. The pH of this solution was within the range of from 6.5 to 7.5.

The average amount of processing per day in the above-mentioned Process A was 0.5 m². Next, the processing rate per day was varied as shown in Table 1 and Processes B and C were carried out in the same manner as Process A. Processes D to I were carried out subsequently as shown in Table 1.

After continuous processing, an unexposed sample was processed and the residual silver content was measured using the fluorescence X-ray method. An examination was made to ascertain whether any precipitation had occurred in the bleach-fixing bath or the water washing bath. The results obtained are shown in Table 1.

Moreover, the open area of each processing tank (e.g., the color developing bath, the bleach-fixing bath and the water washing bath) in the process described above was 0.05 $cm^{-1}$.

TABLE 1

| No. | Process | Bleach-Fixing Bath Perservative | Open Area of Each Processing Tank ($cm^{-1}$) | Average Amount of Processing per Day ($m^2$) | Residual Silver Content ($\mu g/m^2$) | Occurrence of Precipitation P2 | Occurrence of Precipitation PS | Remarks |
|---|---|---|---|---|---|---|---|---|
| 1 | A | Comparative Compound | 0.05 | 0.5 | 5.3 | No | Yes | Comparison |
| 2 | B | Comparative Compound | " | 10.0 | 1.0 | No | No | " |
| 3 | C | Comparative Compound | " | 25.0 | 9.7 | No | No | " |
| 4 | D | Compound S-1 | " | 0.5 | 1.1 | No | No | Invention |
| 5 | E | " | " | 10.0 | 0.8 | No | No | " |
| 6 | F | " | " | 25.0 | 1.0 | No | No | " |
| 7 | G | Compound S-2 | " | 0.5 | 1.0 | No | No | " |
| 8 | H | " | " | 10.0 | 0.9 | No | No | " |
| 9 | I | " | " | 25.0 | 0.9 | No | No | " |

Ammonium sulfite was used as the comparative compound in Table 1.

Also, when the average amount of processing per day in Process A was changed to 0.05 $m^2$, the residual silver content was 8.5 $\mu g/m^2$ which was not suitable for practical use, and there were desilvering failure and precipitation in the P2 (bleach-fixing) and PS (water washing).

Further, when in Process A, the open area value of the bleach-fixing bath and water washing bath was changed to 0.20 $cm^{-1}$ and the average amount of processing per day was changed to 0.2 $m^2$, the residual silver content was 7.5 $\mu g/m^2$ which was not suitable for practical use, and there were desilvering failure and precipitation in the P2 and PS.

As shown by the results in Table 1, when processing was carried out with various processing rates per day, there was no desilvering failure or precipitation in the bleach-fixing bath or in the water washing bath with the processing method of the present invention.

Also, even if in Processes D, E and F, the preservative, Compound S-1, was changed to compounds S-14, S-35, S-38, respectively, the same results as described above were obtained.

EXAMPLE 2

Continuous processing was carried out in the same manner as in Process G in Example 1 except that the open area was varied (provided that the open area value of the color developing bath is 0.05 $cm^{-1}$). The amounts of residual silver and precipitate formation were investigated in the same manner as in Example 1. The results obtained are shown in Table 2.

TABLE 2

| No. | Process | Bleach-Fixing Bath Perservative | Open Area of Each Processing Tank ($cm^{-1}$) | Average Amount of Processing per Day ($m^2$) | Residual Silver Content ($\mu g/m^2$) | Occurrence of Precipitation P2 | Occurrence of Precipitation PS | Remarks |
|---|---|---|---|---|---|---|---|---|
| 10 | J | Compound S-2 | 0.20 | 0.5 | 3.4 | No | Yes | Comparison |
| 11 | K | " | 0.10 | " | 1.8 | No | Yes | " |
| 12 | G | " | 0.05 | " | 1.0 | No | No | Invention |
| 13 | L | " | 0.03 | " | 1.1 | No | No | " |
| 14 | M | " | 0.05 | " | 1.0 | No | No | " |
| 15 | N | " | " | 25 | 1.8 | No | No | " |
| 16 | O | " | " | " | 0.8 | No | No | " |

A movable lid was fitted to each processing tank in Processes M and O. On comparing Processes N and O slightly more desirable results with a smaller amount of residual silver were obtained with Process O.

Also, when in Process G, the open area value of the bleach-fixing bath was changed to 0.20 $cm^{-1}$, there was no precipitation in the P2 and PS but the residual silver content was 3.4 $\mu g/m^2$. On the other hand, when in Process G, the open area value of the water washing was changed to 0.2 $cm^{-1}$, the residual silver content was 1.0 $\mu g/m^2$ which was suitable for practical use, and there was no precipitation in the P2 and little precipitation in the PS.

Sample 201 was then prepared by producing the layer structure indicated below on a paper support which had been laminated on both sides with polyethylene. The coating solutions were prepared in the manner indicated below.

Preparation of the First Layer Coating Liquid:

Ethyl acetate (27.2 ml) and 4.1 g each of the solvents (Solv-3) and (Solv-6) were added to 19.1 g of a yellow coupler (ExY-1), 4.4 g of a colored image stabilizer (Cpd-14) and 1.8 g of a colored image stabilizer (Cpd-6) to form a solution which was emulsified and dispersed in 185 ml of a 10 wt% aqueous gelatin solution which contained 8 ml of 10 wt% sodium dodecylbenzenesulfonate. On the other hand, a silver halide emulsion (a mixture of a cubic emulsion of AgBr content 80.0 mol%, average grain size 0.85 $\mu m$, variation coefficient 0.08, and a cubic emulsion of AgBr content 80.0 mol%, average grain size 0.62 $\mu m$, variation coefficient 0.07 in the ratio of 1/3 (mol ratio of silver)) was sulfur sensitized and an emulsion was prepared by adding $5.0\times10^{-4}$ mol per mol of silver of the blue-sensitive sensitizing dye indicated below. The aforementioned emulsified dispersion was then mixed with this emulsion to provide the first layer coating solution of which the composition is indicated below.

The coating solutions for the second to the seventh layers were prepared using the same method as used to prepare the first coating solution Moreover, 1-oxy-3,5-dichloro-s-triazine sodium salt was used as a gelatin hardening agent in each layer.

The spectrally sensitizing dyes used in each layer were as indicated below.

Blue-Sensitive Emulsion Layer

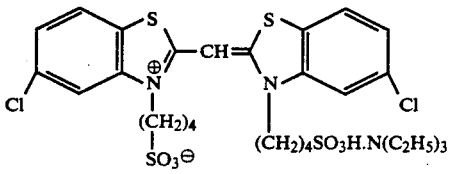

($5.0 \times 10^{-4}$ mol per mol of emulsion)

Green-Sensitive Emulsion Layer

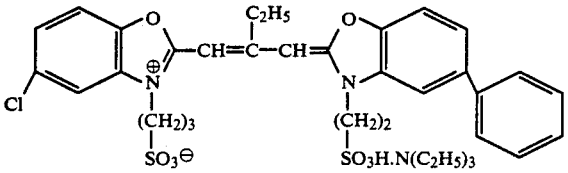

($4.0 \times 10^{-4}$ mol per mol of emulsion)

and

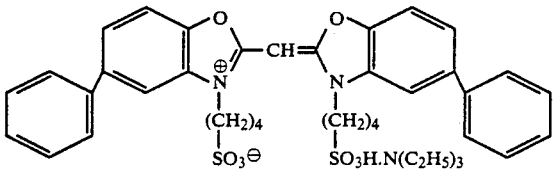

($7.0 \times 10^{-5}$ mol per mol of emulsion)

Red-Sensitive Emulsion Layer

-continued

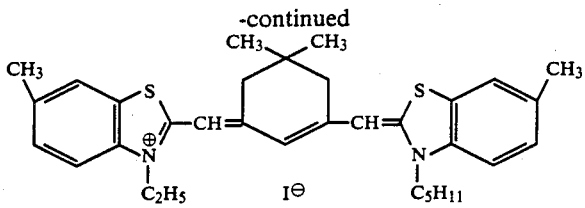

($0.9 \times 10^{-4}$ mol per mol of emulsion)

The compound indicated below was added at the rate of $2.6 \times 10^{-3}$ mol per mol of silver halide to the red-sensitive emulsion layer.

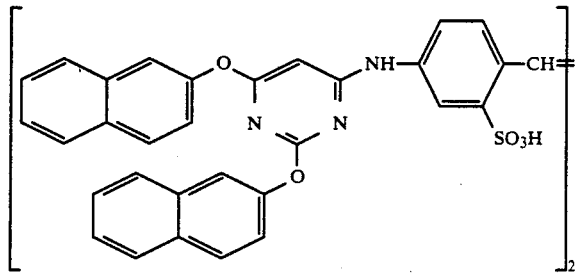

Furthermore, 1-(5-methylureidophenyl)-5-mercaptotetrazole was added at a rate of $4.0\times10^{-6}$ mol, $3.0\times10^{-5}$ mol and $1.0\times10^{-5}$ mol per mol of silver halide to the blue-sensitive, green-sensitive and redsensitive emulsion layers, respectively, and 2-methyl-5-octylhydroquinone was added at a rate of $8.0\times10^{-3}$ mol, $2.0\times10^{-2}$ mol and $2.0\times10^{-2}$ mol per mol of silver halide to the blue-sensitive, green-sensitive and redsensitive emulsion layers, respectively.

Furthermore, 4-hydroxy-6-methyl-1,3,3a,7-tetraazaindene was added at a rate of $1.2\times10^{-2}$ mol and $1.1\times10^{-2}$ mol per mol of silver halide to the blue-sensitive and green-sensitive emulsion layers, respectively. Furthermore, the dyes shown below were used as antiirradiation dyes.

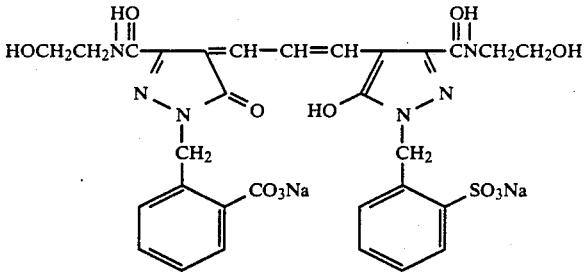

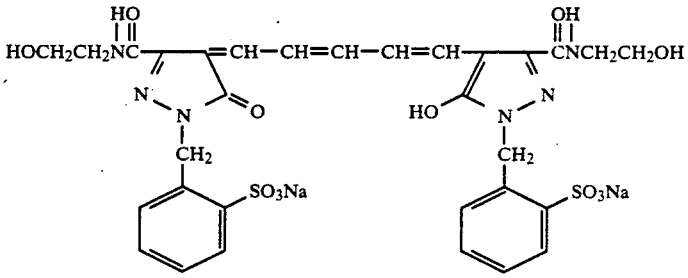

Layer Structure:

The composition of each layer is shown below. The numerical values indicate the coated weights (g/m²) and the coated weights are indicated as coated weights calculated as silver in the case of the silver halide emulsions.

Support

A paper support laminated on both sides with polyethylene. (White pigment ($TiO_2$) and a bluish dye (ultramarine) were present in the polyethylene on the first layer side.)

| | |
|---|---|
| First Layer: Blue-Sensitive Layer | |
| The Aforementioned Silver Chlorobromide Emulsion (AgBr content: 80 mol %) | 0.26 |
| Gelatin | 1.83 |
| Yellow Coupler (ExY-1) | 0.83 |
| Colored Image Stabilizer (Cpd-14) | 0.19 |
| Colored Image Stabilizer (Cpd-6) | 0.08 |
| Solvent (Solv-3) | 0.18 |
| Solvent (Solv-6) | 0.18 |
| Second Layer: Anti-Color-Mixing Layer | |
| Gelatin | 0.99 |
| Anti-Color-Mixing Agent (Cpd-9) | 0.08 |
| Solvent (Solv-1) | 0.16 |
| Solvent (Solv-4) | 0.08 |
| Third Layer: Green-Sensitive Layer | |
| Silver Chlorobromide Emulsion (a mixture of a cubic silver chlorobromide emulsion of AgBr content 90 mol %, average grain size 0.47 μm, variation coefficient 0.12 and a cubic silver chlorobromide emulsion of AgBr content 90 mol %, average grain size 0.36 μm, variation coefficient 0.09 in the ratio 1/1) | 0.14 |
| Gelatin | 1.79 |
| Magenta Coupler (compound indicated in Table 1) | 0.32 |
| Colored Image Stabilizer (Cpd-9) | 0.20 |
| Colored Image Stabilizer (Cpd-10) | 0.03 |
| Colored Image Stabilizer (Cpd-15) | 0.01 |
| Colored Image Stabilizer (Cpd-12) | 0.04 |
| Solvent (Solv-4) | 0.65 |
| Fourth Layer: Ultraviolet Absorbing Layer | |
| Gelatin | 1.58 |
| Ultraviolet Absorber (UV-1) | 0.47 |
| Anti-Color-Mixing Agent (Cpd-7) | 0.05 |
| Solvent (Solv-5) | 0.24 |
| Fifth Layer: Red-Sensitive Layer | |
| Silver Chlorobromide Emulsion (a mixture of a cubic silver chlorobromide emulsion of AgBr content 70 mol %, average grain size 0.49 μm variation coefficient 0.08 and a cubic silver chlorobromide emulsion of AgBr content 70 mol %, average grain size 0.34 μm, variation coefficient 0.10 in the ratio 1/2) | 0.23 |
| Gelatin | 1.34 |
| Cyan Coupler (ExC) | 0.30 |
| Colored Image Stabilizer (a 2/4/4 mixture of Cpd-2, Cpd-1 and Cpd-16) | 0.17 |
| Colored Image Stabilizer (Cpd-6) | 0.40 |
| Solvent (Solv-6) | 0.20 |
| Sixth Layer: Ultraviolet Absorbing Layer | |
| Gelatin | 0.53 |
| Ultraviolet Absorber (UV-1) | 0.16 |
| Anti-Color-Mixing Agent (Cpd-7) | 0.02 |
| Solvent (Solv-5) | 0.08 |
| Seventh Layer: Protective Layer | |
| Gelatin | 1.33 |
| Acrylic Modified Poly(vinyl alcohol) (degree of modification: 17%) | 0.17 |
| Liquid Paraffin | 0.03 |

(UV-1) Ultraviolet Absorber

A 4/2/4 (by weight) mixture of

-continued

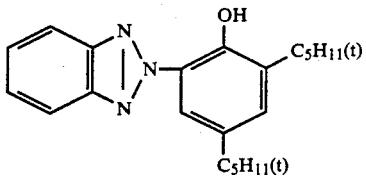

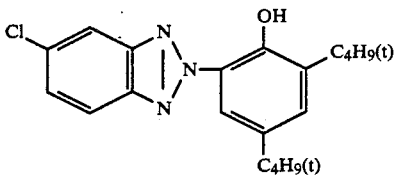

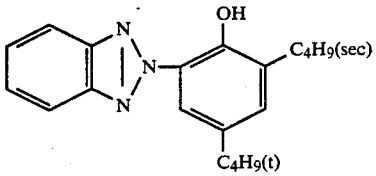

(Solv-1) Solvent

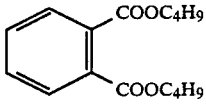

(Solv-2) Solvent

A 2/1 (by volume) mixture of

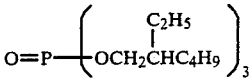

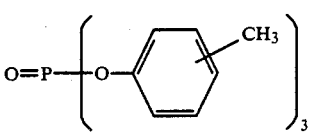

(Solv-3) Solvent $O{=}P{\leftarrow}O{-}C_9H_{19}(iso))_3$ (Solv-4) Solvent

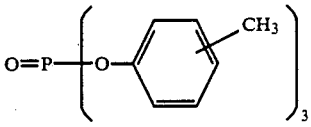

(Solv-5) Solvent

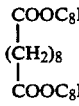

(Solv-6) Solvent

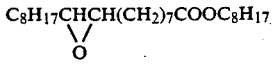

ExY-1

-continued

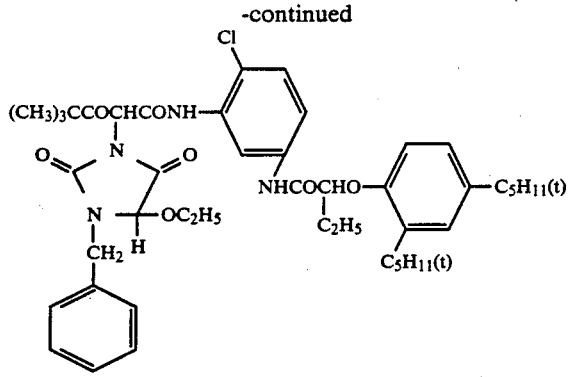

(ExC) Cyan Coupler
A 1/1 (by mol) mixture of

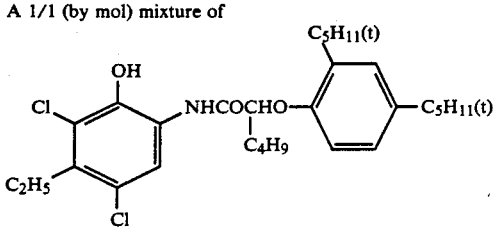

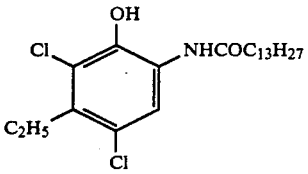

Sample 201, prepared in the manner described above, was processed continuously using the operations indicated below.

| Processing Operation | Temperature (°C.) | Time (sec) | Replenishment Rate (ml/m²) | Tank Capacity (l) |
|---|---|---|---|---|
| Color Development | 35 | 45 | 80 | 10 |
| Bleach-Fixing | 30–36 | 45 | 60 ← | 10 |
| Water Washing (1) | 30–37 | 30 | — ← | 5 |
| Water Washing (2) | " | " | — ← | 5 |
| Water Washing (3) | " | " | 100 | 5 |
| Drying | 70–85 | 60 | | |

The replenishment rates indicated above are the replenishment rates per square meter of photographic material. Furthermore, as shown by the arrows, the overflow of water washing water is introduced into the previous tank to provide a countercurrent replenishment system, and the overflow from water washing (1) was introduced into the bleach-fixing bath. The continuous processing was carried out in a room at 20° C., 75% humidity with a carbon dioxide gas concentration of 1,200 ppm. The open area of the automatic processor used in the experiments was 0.02 (cm²/ml), and the amount of evaporation per day was 60 ml. The running time on this occasion was 10 hours.

The composition of each processing bath used is shown below.

| | Mother Liquor | Replenisher |
|---|---|---|
| Color Developing Bath: | | |
| Water | 800 ml | 800 ml |
| Ethylenediaminetetramethylene-phosphonic Acid | 5.0 g | 5.0 g |
| N,N-(Biscarboxymethyl)hydrazine | 0.03 mol | 0.05 mol |
| Triethanolamine | 0.04 mol | 0.04 mol |
| Sodium Chloride | 0.4 g | — |
| Potassium Carbonate | 25.0 g | 25.0 g |
| N-Ethyl-N-(β-methanesulfonamido-ethyl)-3-methyl-4-aminoaniline Sulfate | 5.0 g | 10.0 g |
| Fluorescent Whitener ("Whitex-4", made by Sumitomo Kagaku) | 2.0 g | 4.5 g |
| Water to make | 1,000 ml | 1,000 ml |
| pH (25° C.) | 10.05 | 10.85 |
| Bleach-Fixing Bath: (Tank Solution = Replenisher) | | |
| Water | | 400 ml |
| Ammonium Thiosulfate (70 wt %) | | 200 ml |
| Preservative (Compound in Table 3) | | 0.3 mol |
| Ethylenediaminetetraacetic Acid Ferric Ammonium Salt | | 100 g |
| Ethylenediaminetetraacetic Acid Disodium Salt | | 5 g |
| Glacial Acetic Acid | | 5 ml |
| Water to make | | 1,000 ml |
| pH (25° C.) | | 5.80 |

Water Washing Water (Tank Solution=Replenisher)

Town water was passed through a mixed bed column packed with an H-type strongly acidic cation exchange resin ("Amberlite IR-120", made by Rohm & Haas Co.) and an OH-type anion exchange resin ("Amberlite IR-400", made by the same company) to provide water of the quality indicated below.

| | |
|---|---|
| Calcium | 0.3 mg/liter |
| Magnesium | not more than 0.1 mg/liter |
| pH | 6.5 |
| Electrical Conductivity | 5.0 μs/cm |

In Process P described above, the average amount of processing per day was 2.5 m². Continuous processing was then carried out while varying the preservative in the bleach-fixing bath in the manner shown in Table 3.

TABLE 3

| | Preservative | Occurrence of Precipitation in the Water Washing Bath |
|---|---|---|
| Processing P (Comparison) | Comparative Compound | Yes |
| Processing Q (Invention) | Compound S-1 | No |
| Processing R (Invention) | Compound S-2 | No |
| Processing S (Invention) | Compound S-35 | No |
| Processing T (Invention) | Compound S-25 | No |

Comparative Compound: Sodium Sulfite

As shown by the results in Table 3, no precipitation occurred as a result of the carry-over of bleach-fixing bath into the water washing bath and the oxidative degradation when a preservative of the present invention is used.

EXAMPLE 3

Sample 301 prepared by the same manner as in Example 2 was continuously processed by the same manner as in Example 2 except that the following stabilizing bath (solution) was used in place of the water washing water of Example 2.

| Stabilizing Bath (solution): | |
|---|---|
| Formalin (37 wt %) | 0.1 g |
| Formalin Sulfite Adduct | 0.7 g |
| 5-Chloro-2-methyl-4-isothiazoline-3-one | 0.02 g |
| 2-Methyl-4-isothiazoline-3-one | 0.01 g |
| Triethanolamine | 2.0 g |
| Water to make | 1,000 ml |
| pH (25° C.) | 4.0 |

The same results as in Example 2 were obtained without occurrence of precipitation in the stabilizing bath.

The present invention provides a processing method with which desilvering failure is markedly reduced and with which there is very little precipitation in the bleaching bath even when continuous processing is carried out. Moreover, the fitting of a movable lid to the apparatus has a pronounced effect on the above-mentioned processing method.

While the invention has been described in detail and with reference to specific embodiments thereof, it will be apparent to one skilled in the art that various changes and modifications can be made therein without departing from the spirit and scope thereof.

What is claimed is:

1. A method for processing a silver halide color photographic material comprising:

imagewise exposing the material and continuously processing the material in a automatic processor wherein the bleach-fixing bath contains (i) at least one organic acid ferric complex salt present in an amount of from 0.01 to 1.0 mol per liter of the bleach-fixing bath, and (ii) at least one sulfinic acid present in an amount of from 0.05 to 100 g per liter of the bleach fixing bath;

wherein the open area value (X) of at least one of the bleach-fixing bath and the water washing bath during the processing is not more than 0.05 $cm^{-1}$.

2. The method for processing a silver halide color photographic material as claimed in claim 1, wherein said open area value (X) is from 0.001 to 0.05 $cm^{-1}$.

3. The method for processing a silver halide color photographic material as claimed in claim 1, wherein said organic acid ferric complex salt is aminopolycarboxylic acid ferric complex salt.

4. The method for processing a silver halide color photographic material as claimed in claim 1, wherein said sulfinic acid is a compound in which at least one $—SO_2H$ group is bonded to an aromatic group or a heterocyclic group, an alkali metal, an alkaline earth metal, a nitrogen containing organic base or an ammonium salt.

5. The method for processing a silver halide color photographic material as claimed in claim 1, wherein said sulfinic acid is a compound in which at least one $—SO_2H$ group is bonded to an aromatic group, an alkali metal aromatic sulfinate or an alkaline earth metal aromatic sulfinate.

6. The method for processing a silver halide color photographic material as claimed in claim 1, wherein said open area value (X) of said bleach-fixing bath and said water washing bath is not more than 0.05 $cm^{-1}$.

7. The method for processing a silver halide color photographic material as claimed in claim 1, wherein said water washing bath is a stabilizing bath which is used in place of water washing bath.

8. The method for processing a silver halide color photographic material as claimed in claim 7, wherein said open area value (X) of said bleach-fixing bath and said stabilizing bath which is used in place of water washing bath is not more than 0.05 $cm^{-1}$.

* * * * *